US011378329B2

(12) United States Patent
Oh et al.

(10) Patent No.: US 11,378,329 B2
(45) Date of Patent: Jul. 5, 2022

(54) ENTRANCE REFRIGERATOR

(71) Applicant: LG ELECTRONICS INC., Seoul (KR)

(72) Inventors: Minkyu Oh, Seoul (KR); Minseok Kim, Seoul (KR); Hyunki Kim, Seoul (KR); Deukwon Lee, Seoul (KR); Juyoung Choi, Seoul (KR); Insun Yeo, Seoul (KR); Kyukwan Choi, Seoul (KR); Yezo Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 104 days.

(21) Appl. No.: 16/798,962

(22) Filed: Feb. 24, 2020

(65) Prior Publication Data

US 2020/0271378 A1 Aug. 27, 2020

(30) Foreign Application Priority Data

Feb. 25, 2019 (KR) ..... 10-2019-0021867
Jul. 18, 2019 (KR) ..... 10-2019-0086984

(51) Int. Cl.

| | |
|---|---|
| ***F25D 23/10*** | (2006.01) |
| ***F25D 17/06*** | (2006.01) |
| ***F25B 21/02*** | (2006.01) |
| *F25D 29/00* | (2006.01) |

(52) U.S. Cl.

CPC ..... *F25D 23/10* (2013.01); *F25D 17/062* (2013.01); *F25D 29/005* (2013.01); *F25D 2700/14* (2013.01)

(58) Field of Classification Search

CPC ..... F25B 21/02; F25D 23/10; F25D 25/02; F25D 25/021; F25D 25/024

See application file for complete search history.

(56) References Cited

U.S. PATENT DOCUMENTS

| | | | | |
|---|---|---|---|---|
| 3,078,682 | A | 2/1963 | Gould | |
| 3,177,678 | A | 4/1965 | Facey, Jr. | |
| 4,726,193 | A | 2/1988 | Burke et al. | |
| 4,738,113 | A | 4/1988 | Rudick | |
| 5,315,830 | A | 5/1994 | Doke et al. | |
| 5,774,053 | A * | 6/1998 | Porter | A47G 29/141 340/568.1 |
| 7,308,796 | B1 | 12/2007 | Eager | |

(Continued)

FOREIGN PATENT DOCUMENTS

| | | |
|---|---|---|
| CA | 2461635 A1 | 9/2005 |
| CN | 2165389 Y | 5/1994 |

(Continued)

OTHER PUBLICATIONS

Chinese Office Action and Search Report for Chinese Application No. 202010110989.7, dated May 26, 2021.

(Continued)

*Primary Examiner* — Lionel Nouketcha
(74) *Attorney, Agent, or Firm* — Birch, Stewart, Kolasch & Birch, LLP

(57) ABSTRACT

In an entrance refrigerator, a printed circuit board (PCB) on which heat generating components are mounted is disposed inside a housing such that air used to cool a heat sink of a cold air supply device cools the PCB, thereby preventing overheating of the PCB.

17 Claims, 19 Drawing Sheets

(56) References Cited

U.S. PATENT DOCUMENTS

| | | | | |
|---|---|---|---|---|
| 2003/0084670 | A1 | 5/2003 | Kim et al. | |
| 2004/0210153 | A1 | 10/2004 | Tsukashima et al. | |
| 2005/0122682 | A1* | 6/2005 | Streit | H05K 7/20154 361/695 |
| 2005/0210884 | A1 | 9/2005 | Tuskiewicz et al. | |
| 2017/0213187 | A1 | 7/2017 | Choi et al. | |
| 2017/0251833 | A1 | 9/2017 | Stolarz et al. | |
| 2018/0087822 | A1 | 3/2018 | Han et al. | |
| 2018/0087824 | A1 | 3/2018 | Han et al. | |
| 2018/0187944 | A1 | 7/2018 | Park et al. | |
| 2018/0283765 | A1 | 10/2018 | Yi et al. | |
| 2019/0033897 | A1* | 1/2019 | Barbier | G01F 1/50 |

FOREIGN PATENT DOCUMENTS

| | | | |
|---|---|---|---|
| CN | 101210760 | A | 7/2008 |
| CN | 201277783 | Y | 7/2009 |
| CN | 102589236 | A | 7/2012 |
| CN | 102914119 | A | 2/2013 |
| CN | 102927748 | A | 2/2013 |
| CN | 203534032 | U | 4/2014 |
| CN | 105389944 | A | 3/2016 |
| CN | 206257869 | U | 6/2017 |
| CN | 206362072 | U | 7/2017 |
| CN | 107084583 | A | 8/2017 |
| CN | 107440482 | A | 12/2017 |
| CN | 207006712 | U | 2/2018 |
| CN | 108344233 | A | 7/2018 |
| CN | 108458540 | A | 8/2018 |
| CN | 108471893 | A | 8/2018 |
| CN | 207922675 | U | 9/2018 |
| CN | 207922676 | U | 9/2018 |
| CN | 108882798 | A | 11/2018 |
| CN | 108917256 | A | 11/2018 |
| EP | 0 920 686 | A1 | 6/1999 |
| EP | 1004487 | B1 | 6/2005 |
| EP | 2980511 | A1 | 2/2016 |
| FR | 1347414 | A | 12/1963 |
| JP | 5-149675 | A | 6/1993 |
| JP | 10-267501 | A | 10/1998 |
| JP | 11-94423 | A | 4/1999 |
| JP | 2017-198360 | A | 11/2017 |
| KR | 10-2011-0033394 | A | 3/2011 |
| KR | 10-2013-0087815 | A | 8/2013 |
| TW | 499559 | B | 8/2002 |
| WO | WO 97/41542 | A1 | 11/1997 |
| WO | WO 2006/087690 | A2 | 8/2006 |

OTHER PUBLICATIONS

Chinese Office Action and Search Report for Chinese Application No. 202010111000.4, dated Jul. 5, 2021.

Chinese Office Action and Search Report for Chinese Application No. 202010106017.0, dated Jun. 25, 2021.

Chinese Office Action and Search Report for Chinese Application No. 202010107774.X, dated May 26, 2021.

Chinese Office Action and Search Report for Chinese Application No. 202010107501.5, dated Jun. 1, 2021.

U.S. Office Action dated Apr. 4, 2022 for U.S. Appl. No. 16/798,617.

U.S. Notice of Allowance for U.S. Appl. No. 16/798,683, dated May 10, 2022.

* cited by examiner

ENTRANCE REFRIGERATOR

CROSS-REFERENCE TO RELATED APPLICATIONS

The present application claims the benefits of priority to Korean Patent Application No. 10-2019-0021867, filed on Feb. 25, 2019, and Korean Patent Application No. 10-2019-0086984, filed on Jul. 18, 2019, all of which are herein incorporated by reference in their entireties.

BACKGROUND

The present disclosure relates to a refrigerator installed at an entrance of a building, such as a home or a business.

Recently, delivery services for delivering fresh goods to predetermined places are being utilized. In particular, when the goods are fresh food, a delivery vehicle is provided with a refrigerator or a warmer to store and deliver the food so as to prevent the food from spoiling or cooling.

Generally, the food is packed in a packaging material and delivered so as to keep the food cool or warm, depending on the type of food. The packaging material is often composed of environmental pollutants such as polystyrene foam. The social atmosphere recently has placed an emphasis on a reduction of an amount of packaging material used.

When a user is at home at the time of a delivery, the delivery person may deliver the food to the user in a face-to-face manner. However, when the user is not at home or when the delivery time is too early or too late, it is difficult for the delivery person to deliver the food in a face-to-face manner.

Therefore, there is a need to be able to deliver the food even if the delivery person does not face the user, and to prevent the food from spoiling or cooling until the food is finally delivered to the user.

To solve this problem, in recent years, a product has been introduced in which a refrigerator is installed at an entrance (e.g. a front door) of a predetermined place, so that a delivery person can deliver the food into the refrigerator in order to keep the food fresh until a user can receive the food by accessing the refrigerator at a convenient time.

Korean Patent Application Publication No. 2011-0033394 (Mar. 31, 2011) discloses an entrance refrigerator mounted on a front door.

The reference discloses a thermoelectric module used to keep a temperature of a storage compartment low. However, the reference does not disclose an arrangement for discharging high-temperature air generated from a heat generating side of the thermoelectric module to the outside.

In addition, the reference does not disclose an arrangement to discharge heat generated by a control board mounted with the various electrical components to the outside.

SUMMARY

One embodiment of the present disclosure provides an entrance refrigerator including a cold air supply device using a thermoelectric element, and in which air for cooling a heat generating surface of the thermoelectric element is used as a printed circuit board (PCB) cooling means.

In an entrance refrigerator according to one embodiment, a PCB on which heat generating components are mounted is disposed inside a housing such that air used to cool a heat sink of a cold air supply device cools the PCB, thereby preventing overheating of the PCB.

In addition, in order to concentrate air flowing into the housing toward the PCB, a flow guide plate may be installed on the bottom surface of the housing.

In addition, the PCB may be fixed to a position spaced apart upward from a discharge port formed in the bottom of the housing, such that the discharge port is not blocked by the PCB to prevent a flow resistance from occurring.

In addition, a controller of the entrance refrigerator according to one embodiment is configured to adjust a rotational speed of a heat dissipation fan depending on an outside temperature of the housing and/or an internal temperature of a storage compartment of the entrance refrigerator, thereby effectively cooling down the PCB and reducing power consumption.

The entrance refrigerator configured as described above according to the embodiment has the following effects.

First, the entrance refrigerator absorbs heat generated from the heat generating surface of the cold air supply device while passing over the PCB and discharges the absorbed heat into the room, thereby preventing overheating of the PCB.

Second, among the electrical components mounted on the PCB, components with high heat dissipation are disposed in a region with a high air flow rate and a high air flow velocity, thereby preventing overheating of the components mounted on the PCB and ensuring component reliability.

Third, a flow guide plate mounted inside the housing may control an air flow direction and an air volume of air forcedly flowing due to the heat dissipation fan, thereby allowing a large amount of air to flow toward components generating a large amount of heat.

Fourth, since indoor air discharged after being suctioned by the heat dissipation fan cools the PCB, no additional structure for cooling the PCB is required, thereby reducing power consumption and reducing the manufacturing cost of the entrance refrigerator.

Fifth, the air flow speed of the heat dissipation fan is adjusted according to the outside temperature and the temperature of the storage compartment of the entrance refrigerator, thereby reducing power consumption required for driving the cold air supply device.

The details of one or more embodiments are set forth in the accompanying drawings and the description below. Other features will be apparent from the description and drawings, and from the claims.

DETAILED DESCRIPTION OF THE EMBODIMENTS

Hereinafter, an entrance refrigerator 10 according to an embodiment will be described in detail with reference to the accompanying drawings.

Figure 1:
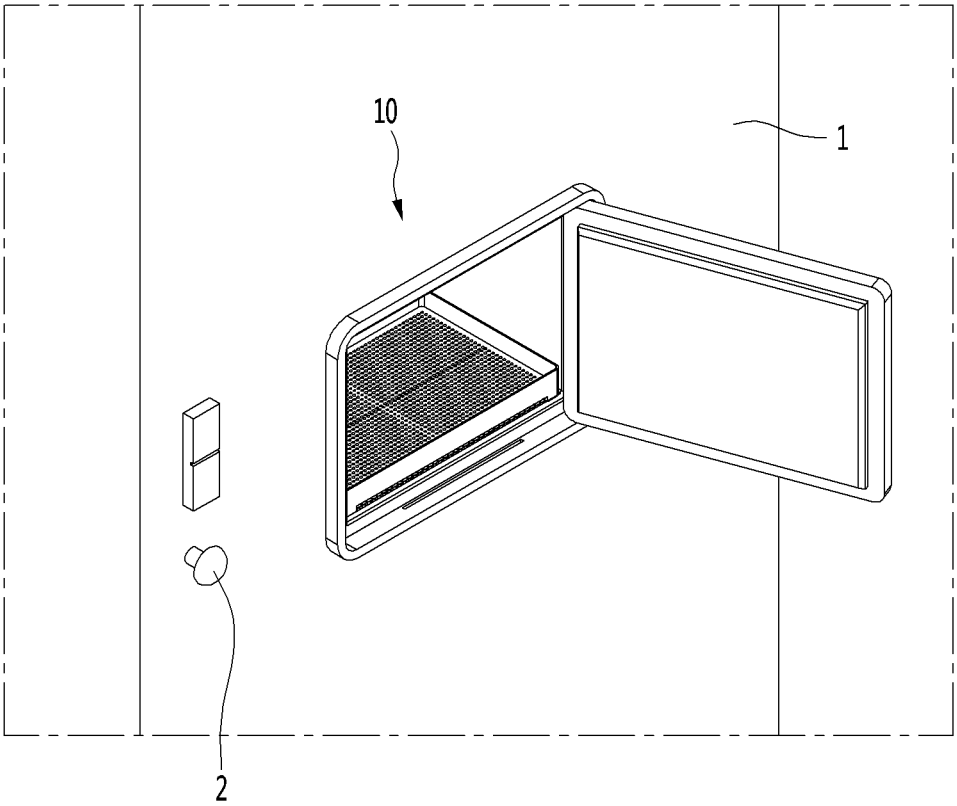
FIG. 1 is a front view of an entrance refrigerator installed at a front door, according to an embodiment.
Figure 2:
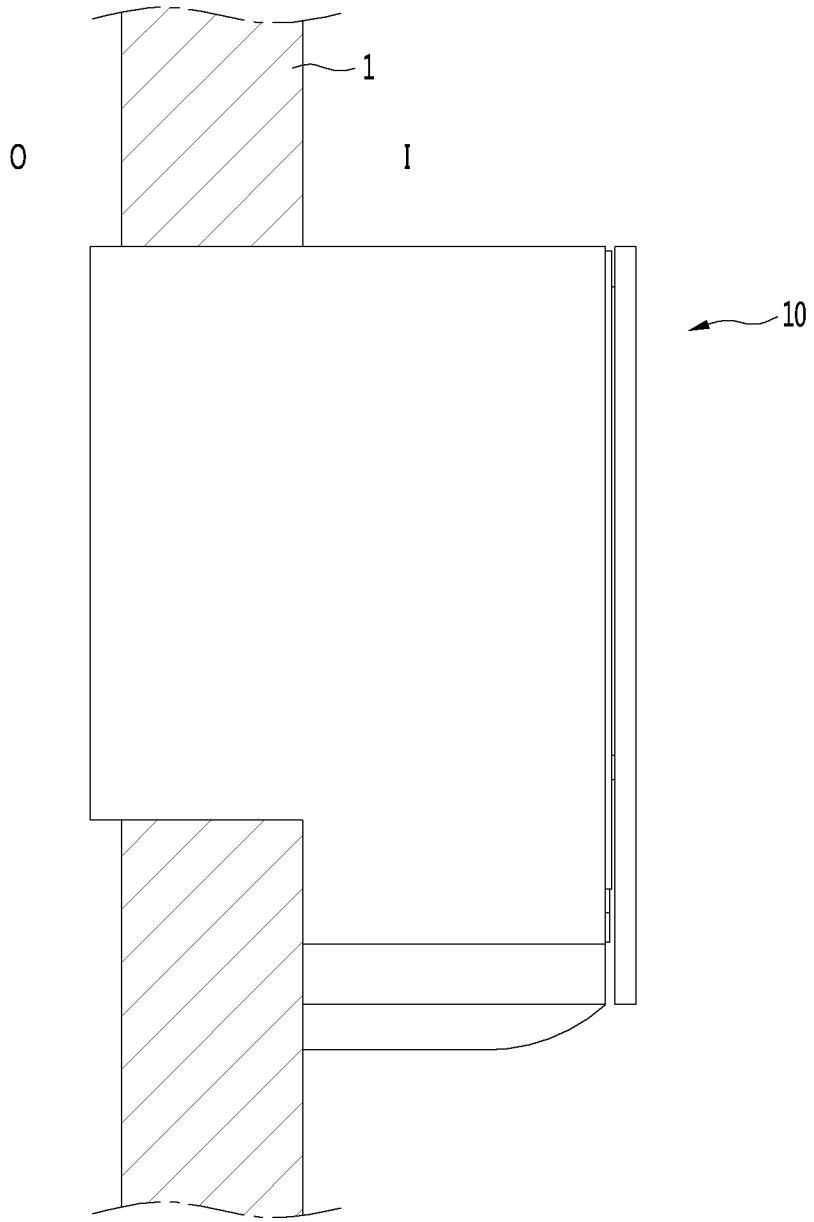
FIG. 2 is a side view of the entrance refrigerator installed at the front door, according to an embodiment.

FIG. 1 is a front view of an entrance refrigerator 10 according to an embodiment installed at a front door of a building, such as a residence, and FIG. 2 is a side view of the entrance refrigerator 10 installed at the front door, according to an embodiment.

Referring to FIGS. 1 and 2, the entrance refrigerator 10 according to the embodiment may be mounted by passing through a suitably-sized opening in a front door 1 or a front wall of a house.

In detail, the entrance refrigerator 10 may be mounted at a point spaced apart from a knob 2 of the front door 1, for example, the entrance refrigerator 10 may be mounted at the center of the front door 1.

In addition, the entrance refrigerator 10 is preferably installed at a height within two meters from the bottom of the front door 1 for convenience of a user and for convenience to a delivery person who delivers goods to the entrance refrigerator 10. Preferably, the entrance refrigerator 10 may be installed at a height in a range of 1.5 meters to 1.7 meters from the bottom of the front door 1.

One portion of the entrance refrigerator 10 is exposed to the outside O (outdoors), and another portion of the entrance refrigerator 10 is exposed to the inside I (indoors). For example, in the entrance refrigerator 10, the surface exposed to the outside O may be defined as the front surface (or outdoor portion) at the front side (exterior side) of the door or wall, and the surface exposed to the inside I may be defined as the rear surface (or indoor portion) at the rear side (interior side) of the door or wall. The door or wall provides a barrier in or around a building, such as, but not limited to, a house, apartment, office, hospital, or the like.

Hereinafter, the configuration of the entrance refrigerator 10 according to the embodiment will be described in more detail with reference to the accompanying drawings.

Figure 3:
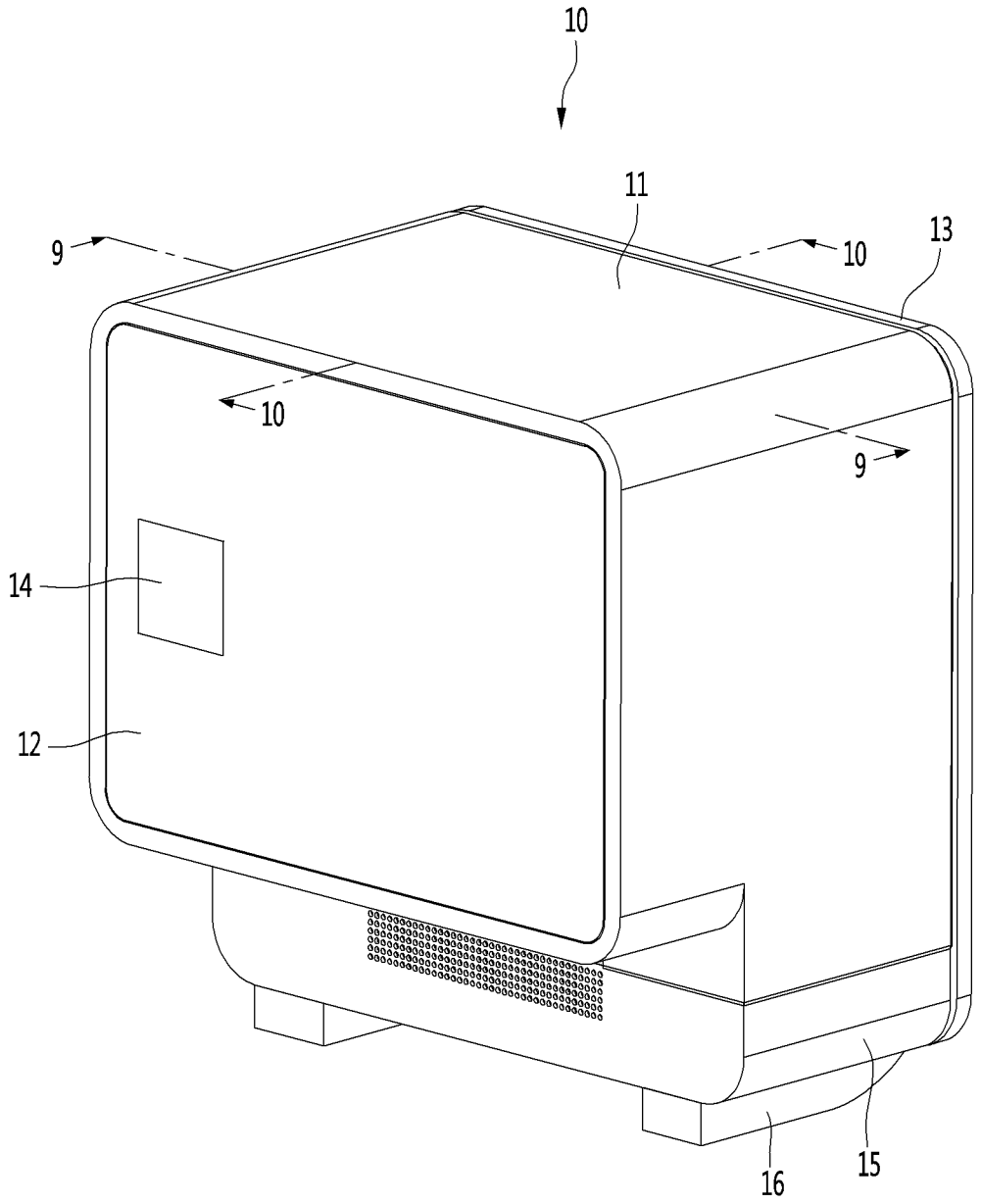
FIG. 3 is a front perspective view of the entrance refrigerator according to an embodiment.
Figure 4:
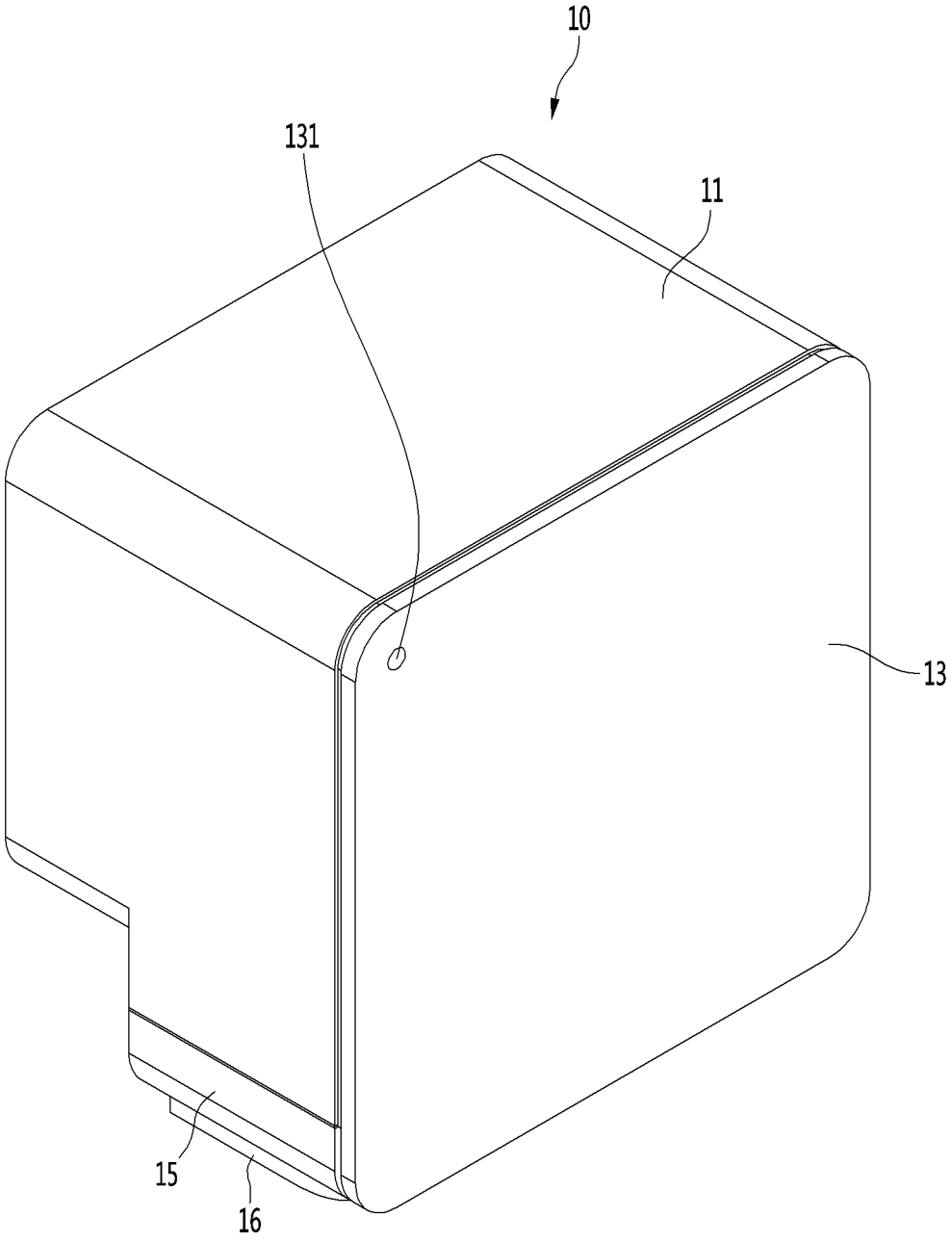
FIG. 4 is a rear perspective view of the entrance refrigerator according to an embodiment.
Figure 5:
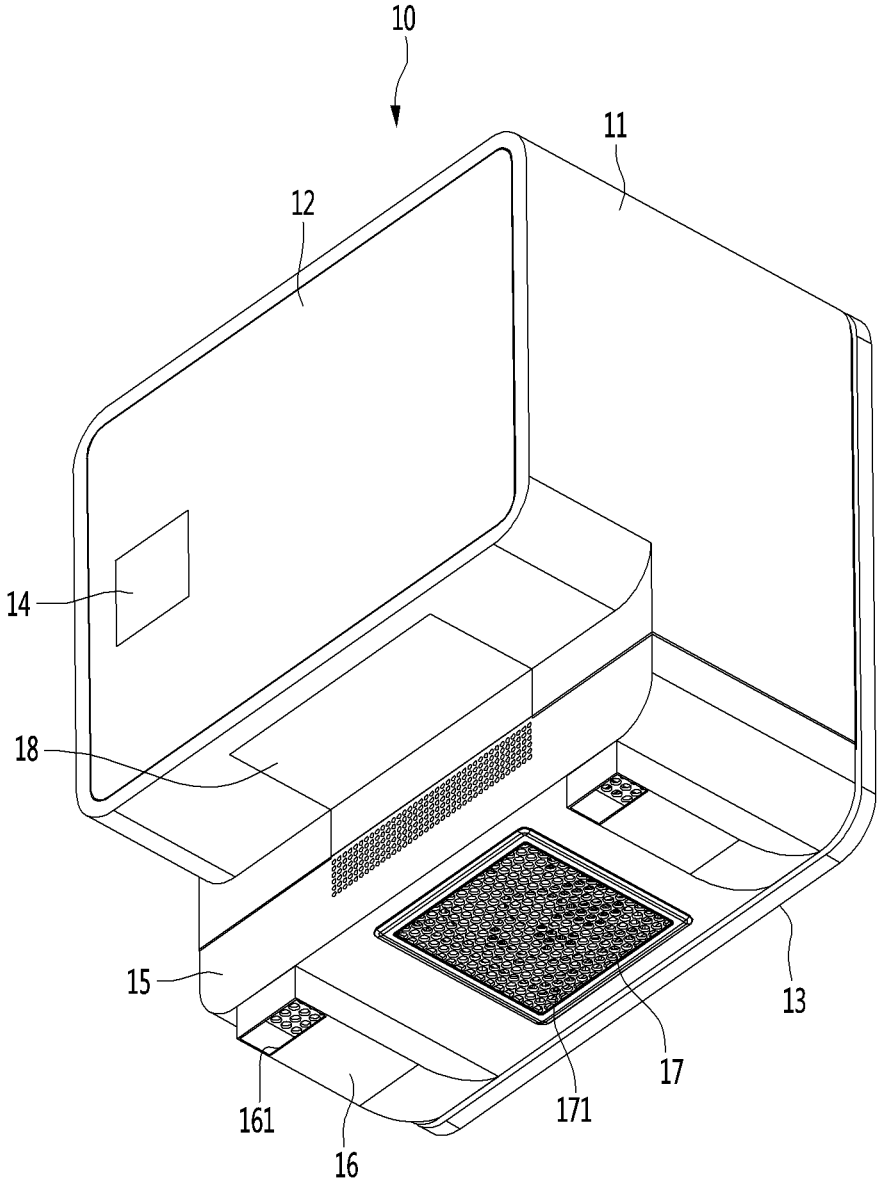
FIG. 5 is a bottom perspective view of the entrance refrigerator according to an embodiment.

FIG. 3 is a front perspective view of the entrance refrigerator 10 according to an embodiment, FIG. 4 is a rear perspective view of the entrance refrigerator 10, and FIG. 5 is a bottom perspective view of the entrance refrigerator 10.

Referring to FIGS. 3 to 5, the entrance refrigerator 10 according to the embodiment may include a cabinet 11, an outdoor side door 12, an indoor side door 13, and a housing 15.

The cabinet 11 has a front opening provided in a portion of the cabinet 11 located at the front (exterior) side of the door or exterior wall, and a rear opening provided in a portion of the cabinet 11 located at the rear (interior) side of the door or interior wall. The cabinet 11 may have an approximately hexahedral shape with a front wall and a rear wall interconnected by a plurality of side walls. The front opening may be provided in the front wall of the cabinet 11, and the rear opening may be provided in the rear wall of the cabinet 11, although the embodiment is not limited thereto. For example, the front opening and the rear opening may be provided on a same side of the cabinet 11 depending on the location where the entrance refrigerator 10 is being installed. The outdoor side door 12 may be rotatably coupled to the cabinet 11 so as to selectively open or close the front opening of the cabinet 11. The outdoor side door 12 may be opened by the delivery person in order to store goods in the entrance refrigerator 10. In addition, the outdoor side door 12 may be opened by the user so as to withdraw goods from the entrance refrigerator 10.

Here, the term "user" is defined as a person who has ordered goods that are stored in the entrance refrigerator 10 by the delivery person, or as a person having authority to release the goods from the entrance refrigerator 10.

In addition, the indoor side door 13 may be rotatably coupled to the cabinet 11 so as to selectively open or close the rear opening of the cabinet 11.

A display 14 may be provided on the outdoor side door 12. The display 14 may display information about an operating state of the entrance refrigerator 10, an internal temperature of the entrance refrigerator 10, and the presence or absence of goods in the entrance refrigerator 10.

In addition, the delivery person who delivers goods may input a password or the like through the display 14 for opening the outdoor side door 12.

A code scanner for recognizing an encryption code provided in a shipping order or a shipping box may be provided on one side of the outdoor side door 12.

The indoor side door 13 is used by the user within the house to take out goods stored in the entrance refrigerator 10. That is, the user can open the indoor side door 13 to withdraw the goods from the entrance refrigerator 10 and into the house.

A guide light 131 may be provided at one side of the indoor side door 13. The guide light 131 may be a device for informing a user whether or not goods are currently stored in the entrance refrigerator 10. For example, the color of the guide light 131 may be set differently depending on whether goods are stored in the entrance refrigerator 10 or whether the entrance refrigerator 10 is empty. The user may recognize whether there are goods currently being stored even without opening the indoor side door 13.

The housing 15 is provided at the lower end of the cabinet 11, either integrally as part of the cabinet 11 or as a separate element attached to the cabinet 11. A cold air supply device 30 (cold air supplier), to be described later, is accommodated in the housing 15. The front surface of the housing 15 comes into close proximity with the rear surface of the front door 1 or the wall when the entrance refrigerator 10 is mounted on the front door 1 or the wall, and contact between a portion of the front surface of the housing 15 and the rear surface of the front door 1 or the wall cancels the moment due to the eccentric load of the entrance refrigerator 10 within the opening of the front door 1 or the wall.

In detail, the entrance refrigerator 10 according to the embodiment has a structural characteristic in which a volume of a part exposed indoors is larger than a volume of a part exposed outdoors of the front door 1. Therefore, the center of gravity of the entrance refrigerator 10 is formed at a point eccentric rearwardly of the center of the entrance refrigerator 10. As a result, the moment is generated by the load of the entrance refrigerator 10 and the load of goods stored therein. With such an arrangement, it is possible that the entrance refrigerator 10 could be pulled out of the front door 1 by the moment.

However, since the front surface of the housing 15 contacts the rear surface of the front door 1 or the wall, the moment acting on the entrance refrigerator 10 is cancelled, thereby preventing the entrance refrigerator 10 from being separated from the front door 1.

A pair of guide ducts 16 may be provided at left and right edges of the bottom surface of the housing 15. A discharge port 161 is formed at the front end of each guide duct 16 so that indoor room air, which flows into the cold air supply device 30 in the housing 15 and performs a heat dissipation function, may be discharged out of the housing 15.

A guide plate 18 may be provided on an angled surface of the cabinet 11 formed by the bottom surface of the cabinet 11 and the front surface of the housing 15. The function of the guide plate 18 will be described below with reference to the accompanying drawings.

An opening for suctioning indoor room air may be formed in the bottom surface of the housing 15, and a suction plate 17 may be mounted at the opening. A plurality of through-holes 171 may be formed in the suction plate 17, and indoor room air is introduced into the housing 15 through the plurality of through-holes 171. At least part of the indoor room air introduced into the housing 15 is discharged back out of the housing 15 through the discharge ports 161 of the guide ducts 16.

Figure 6:
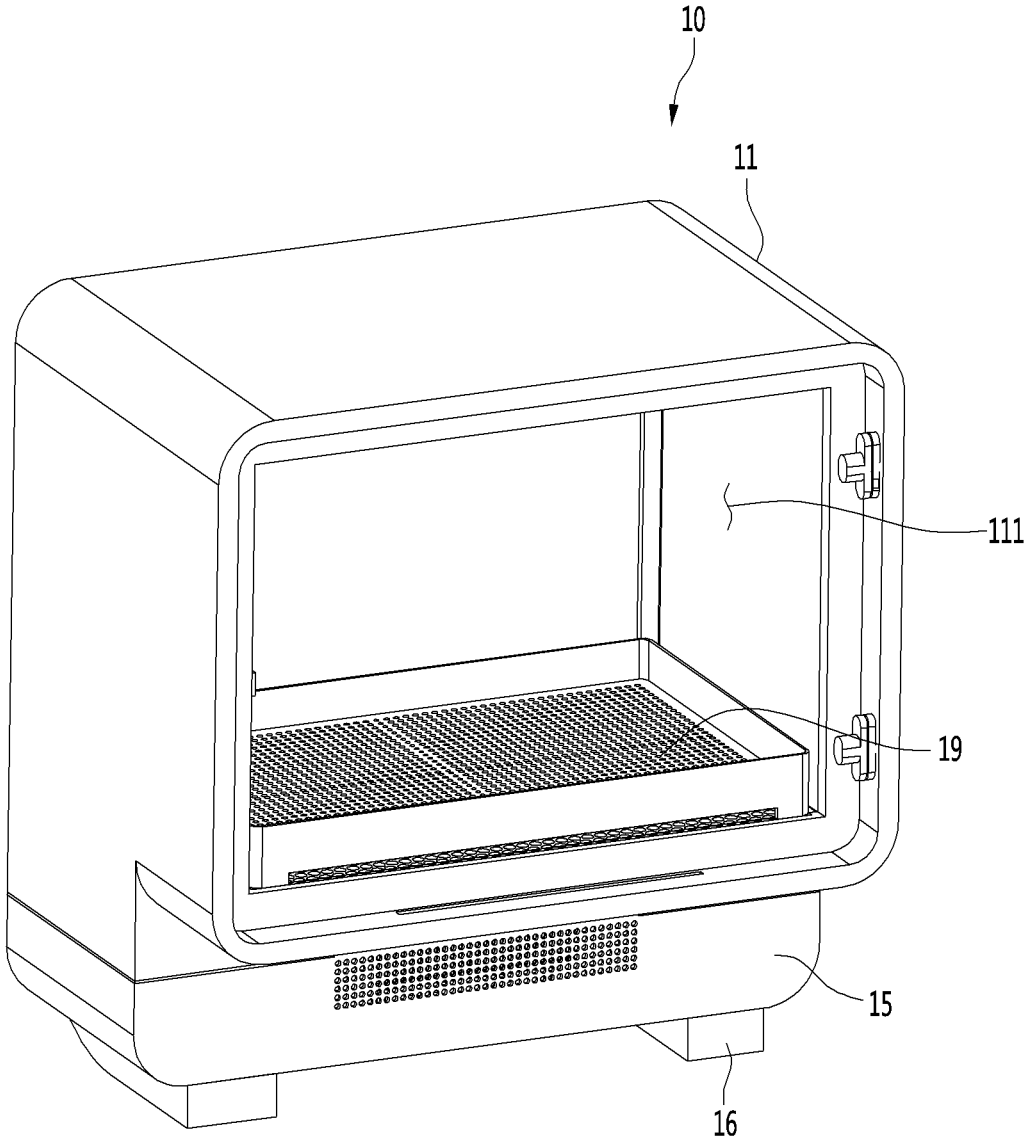
FIG. 6 is a front perspective view of the entrance refrigerator in a state in which an outdoor side door is removed for clarity of illustration, according to an embodiment.
Figure 7:
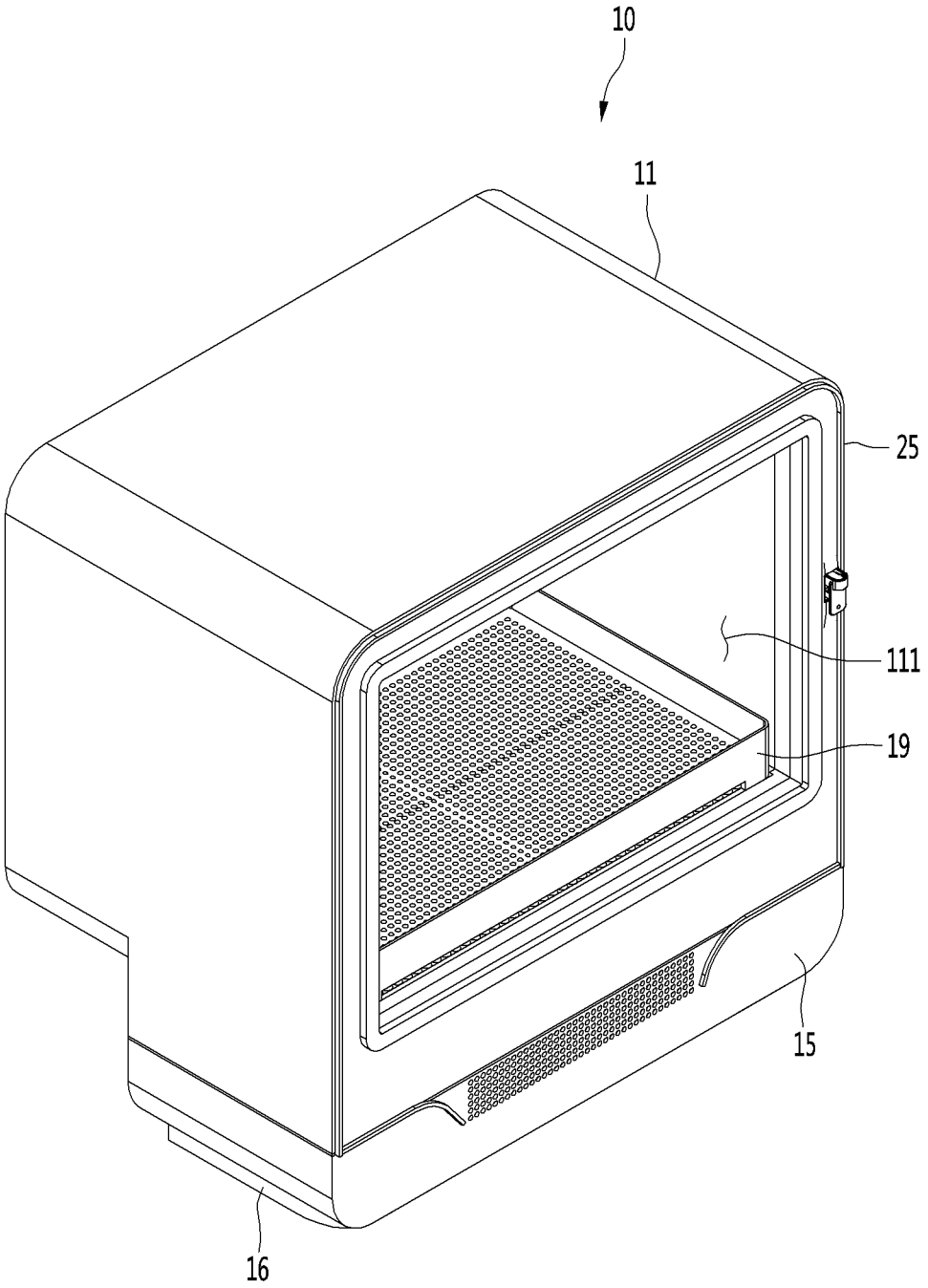
FIG. 7 is a rear perspective view of the entrance refrigerator in a state in which an indoor side door is removed for clarity of illustration, according to an embodiment.

FIG. 6 is a front perspective view of the entrance refrigerator 10 in a state in which the outdoor side door 12 is removed for clarity of illustration, according to an embodiment, and FIG. 7 is a rear perspective view of the entrance refrigerator 10 in a state in which the indoor side door 13 is removed for clarity of illustration, according to an embodiment.

Referring to FIGS. 6 and 7, a storage compartment 111 in which goods may be stored is provided within the cabinet 11. The storage compartment 111 may be considered as a main body of the entrance refrigerator 10 according to the embodiment.

A tray 19 on which goods are placed may be provided at a lower portion of the storage compartment 111.

In addition, a guide rib 25 may be formed along the rear edge of the cabinet 11. The guide rib 25 may protrude a predetermined distance from the rear surface of the cabinet 11 and extend along an edge of the cabinet 11. The guide rib 25 is provided to guide some of the air discharged from the housing 15 upwardly to the area surrounding the indoor side door 13 so that condensation is prevented from forming on a gasket 22 surrounding the rear surface of the indoor side door 13.

Figure 8:
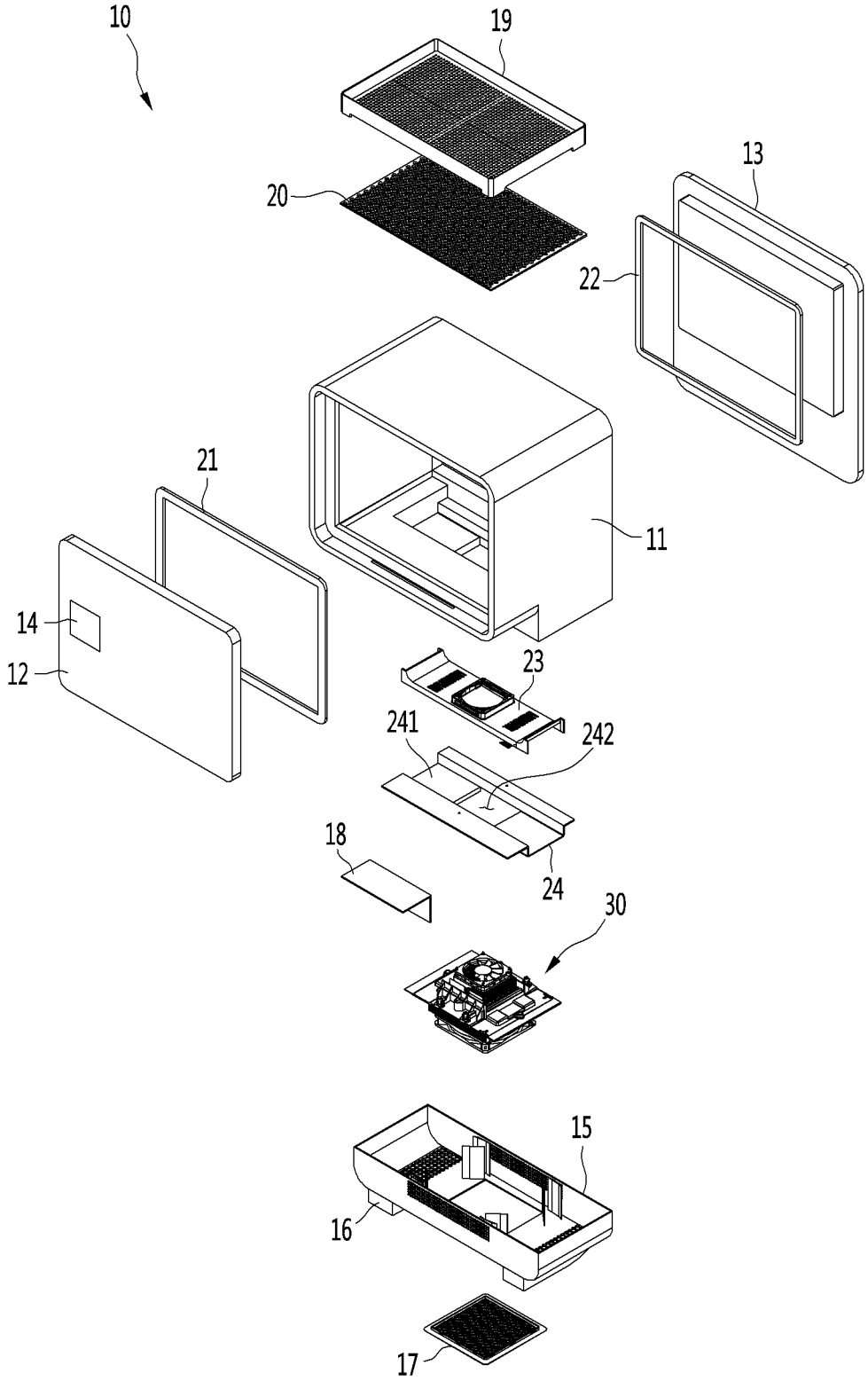
FIG. 8 is an exploded perspective view of the entrance refrigerator according to an embodiment.
Figure 9:
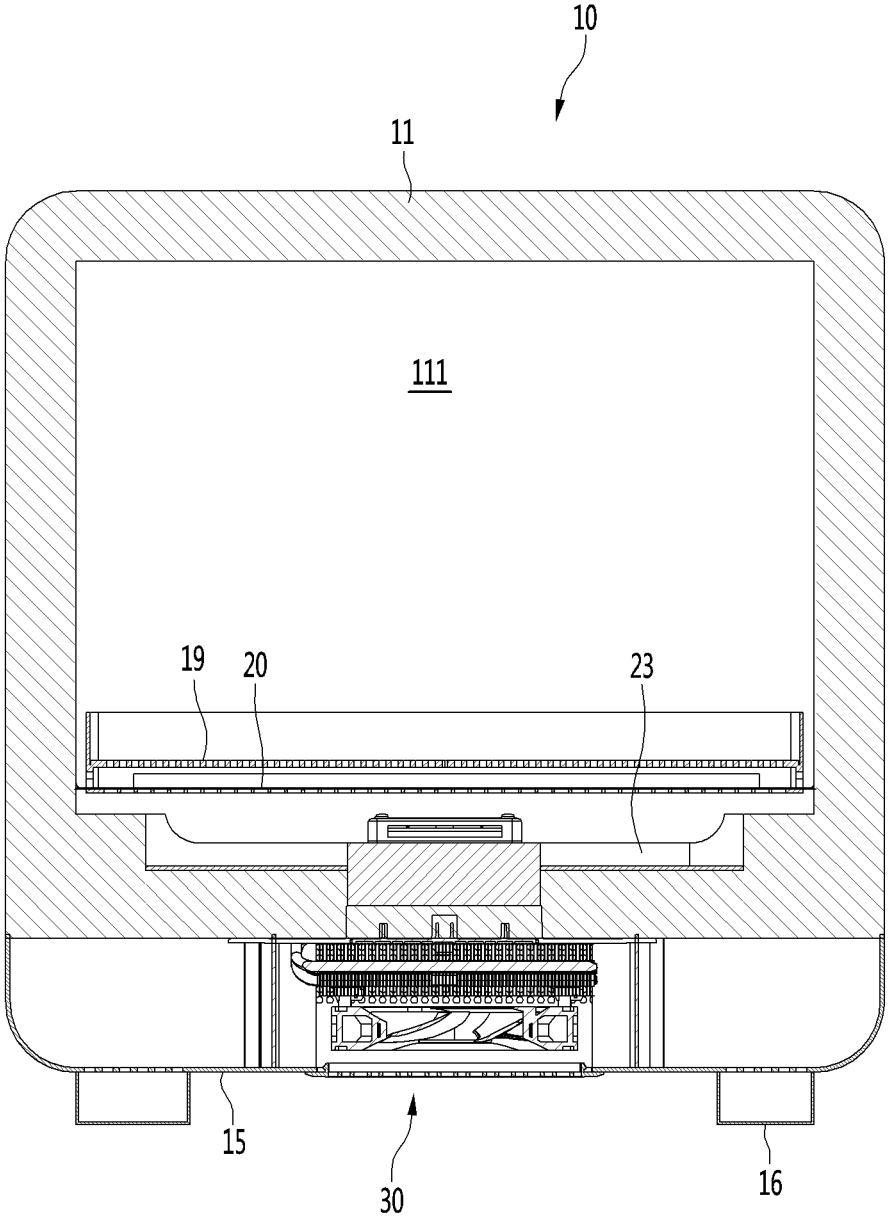
FIG. 9 is a cross-sectional view of the entrance refrigerator, taken along line 9-9 of FIG. 3.
Figure 10:
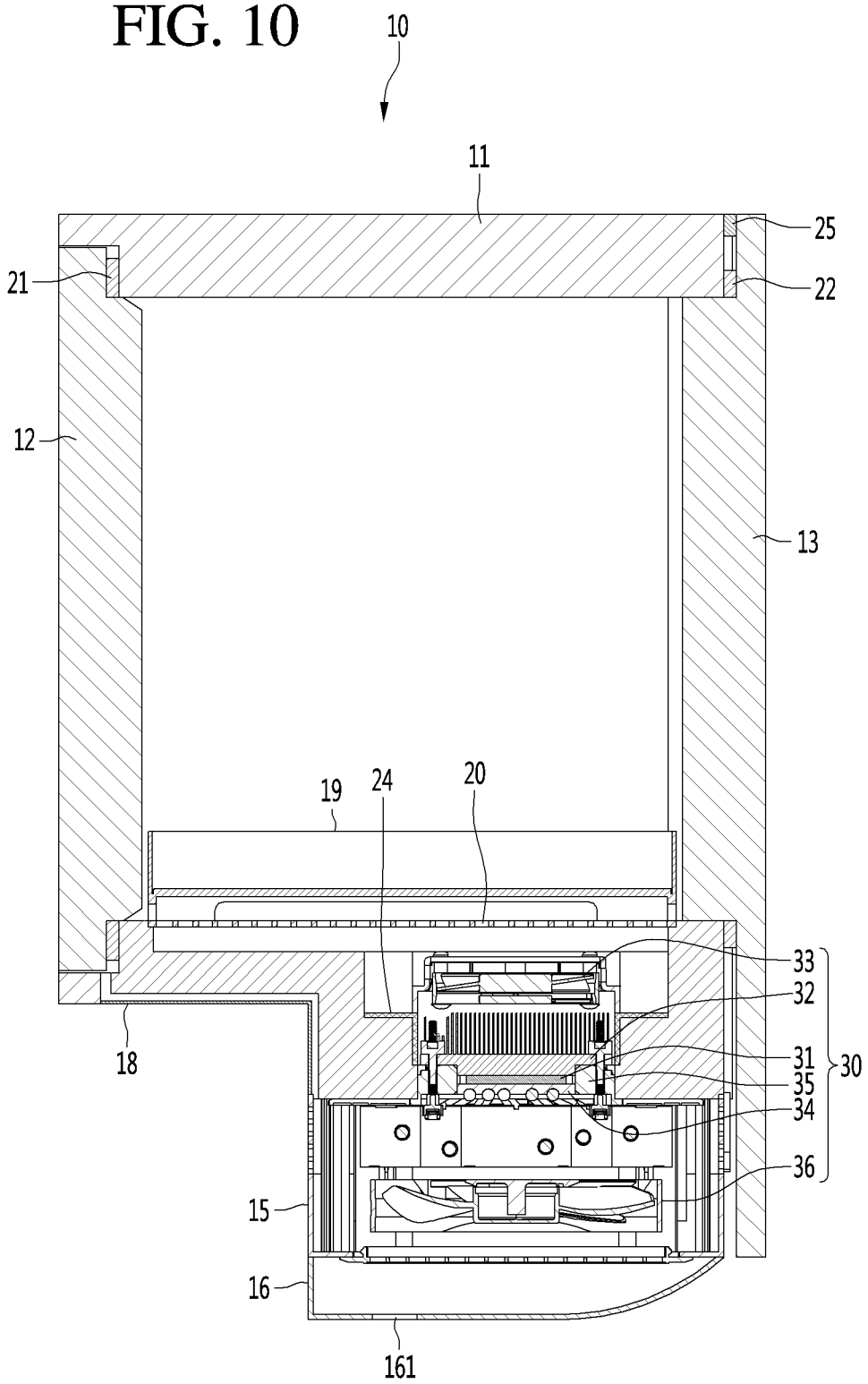
FIG. 10 is a side cross-sectional view of the entrance refrigerator, taken along line 10-10 of FIG. 3.

FIG. 8 is an exploded perspective view of the entrance refrigerator 10 according to an embodiment, FIG. 9 is a cross-sectional view of the entrance refrigerator 10, taken along line 9-9 of FIG. 3, and FIG. 10 is a side cross-sectional view of the entrance refrigerator 10, taken along line 10-10 of FIG. 3.

Referring to FIGS. 8 to 10, as described above, the entrance refrigerator 10 according to the embodiment may include the cabinet 11, the indoor side door 13, the outdoor side door 12, the housing 15, the guide duct 16, the suction plate 17, and the tray 19.

The entrance refrigerator 10 may further include a base plate 20 disposed at the bottom portion of the cabinet 11. The tray 19 may be disposed above the base plate 20. The bottom surface of the tray 19 may be spaced apart upward from the base plate 20.

The entrance refrigerator 10 may further include a cold air supply device 30 accommodated in the housing 15.

The cold air supply device 30 may be a device to which a thermoelectric element (Peltier element) is applied, but the cold air supply device 30 is not limited thereto. For example, a general cooling cycle may be applied to the cold air supply device 30.

When a current is supplied to the thermoelectric element, one surface thereof acts as a heat absorbing surface in which a temperature drops, and the other surface thereof acts as a heat generating surface in which a temperature increases. In addition, when the direction of the current supplied to the thermoelectric element is changed, the heat absorbing surface and the heat generating surface are swapped.

In detail, the cold air supply device 30 may include a thermoelectric element 31, a cold sink 32 attached to the heat absorbing surface of the thermoelectric element 31, a heat absorption fan 33 disposed above the cold sink 32, a heat sink 34 attached to the heat generating surface of the thermoelectric element 31, a heat dissipation fan 36 disposed below the heat sink 34, and an insulation material 35 for preventing heat transfer between the cold sink 32 and the heat sink 34.

The insulation material 35 is provided to surround the side surface of the thermoelectric element 31. The cold sink 32 comes into contact with the upper surface of the insulation material 35, and the heat sink 34 comes into contact with the lower surface of the insulation material 35.

The cold sink 32 and the heat sink 34 may include a thermal conductor directly attached to the heat absorbing surface and the heat generating surface, respectively, of the thermoelectric element 31, and a plurality of heat exchange fins extending from the surface of the thermal conductor.

The heat absorption fan 33 is disposed to face the inside of the cabinet 11, and the heat dissipation fan 36 is disposed directly above the suction plate 17.

The entrance refrigerator 10 may further include a mount plate 24 mounted on the bottom of the cabinet 11, and a flow guide 23 mounted on the upper surface of the mount plate 24.

The mount plate 24 may be formed in a shape in which a rectangular plate is bent a plurality of times to include a bottom portion, a pair of upstanding side portions, and a pair of outwardly extending flange portions. The mount plate 24 may be formed in a shape in which a flow guide seating portion 241, on which the flow guide 23 is seated, is recessed or stepped to a predetermined depth. A through-hole 242 is formed at the bottom portion of the mount plate 24 defining the flow guide seating portion 241. A portion of the cold air supply device 30 may pass through the through-hole 242 and be mounted to the mount plate 24.

In addition, the flow guide 23 may be understood as a device for forming the flow path of the air inside the storage compartment 111 which forcibly flows by the heat absorption fan 33.

The base plate 20 may be disposed above the flow guide 23 to minimize a possibility that foreign substances could fall directly onto the flow guide 23.

An outer gasket 21 is provided on an inner side of the outdoor side door 12 that faces the cabinet 11, and an inner gasket 22 is provided on an inner side of the indoor side door 13 that faces the cabinet 11. The outer gasket 21 and the inner gasket 22 prevent cold air within the storage compartment 111 from leaking to the outside of the entrance refrigerator 10. Alternatively, the outer gasket 21 may be provided on a portion of the cabinet 11 that faces an inner side of the outdoor side door 12, and the inner gasket 22 may be provided on a portion of the cabinet 11 that faces an inner side of the indoor side door 13. The portion of the cabinet 11 may be a contact shoulder 115 to be described later. The outer gasket 21 and the inner gasket 22 prevent cold air within the storage compartment 111 from leaking to the outside of the entrance refrigerator 10.

Figure 11:
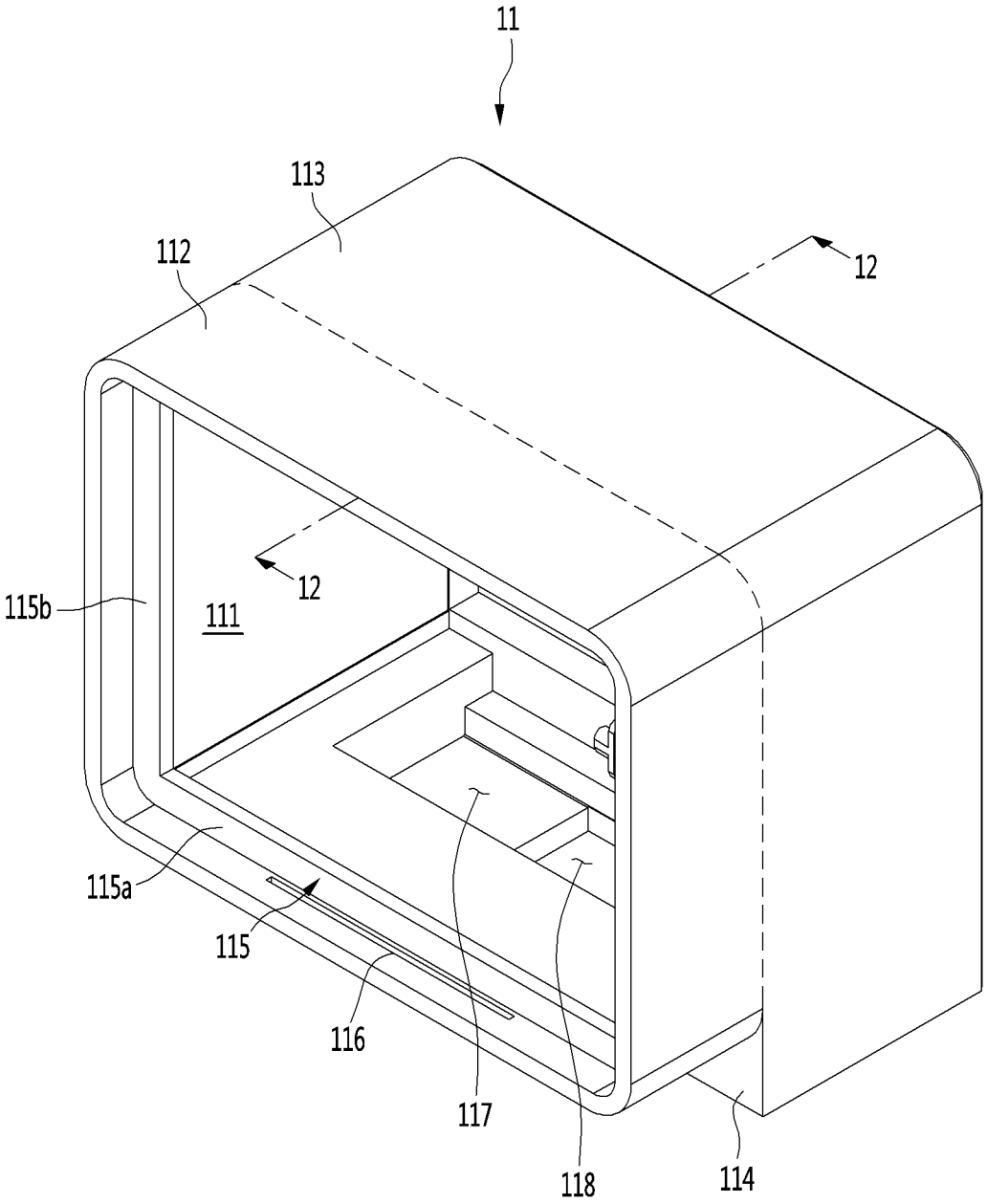
FIG. 11 is a perspective view of a cabinet constituting the entrance refrigerator, according to an embodiment.
Figure 12:
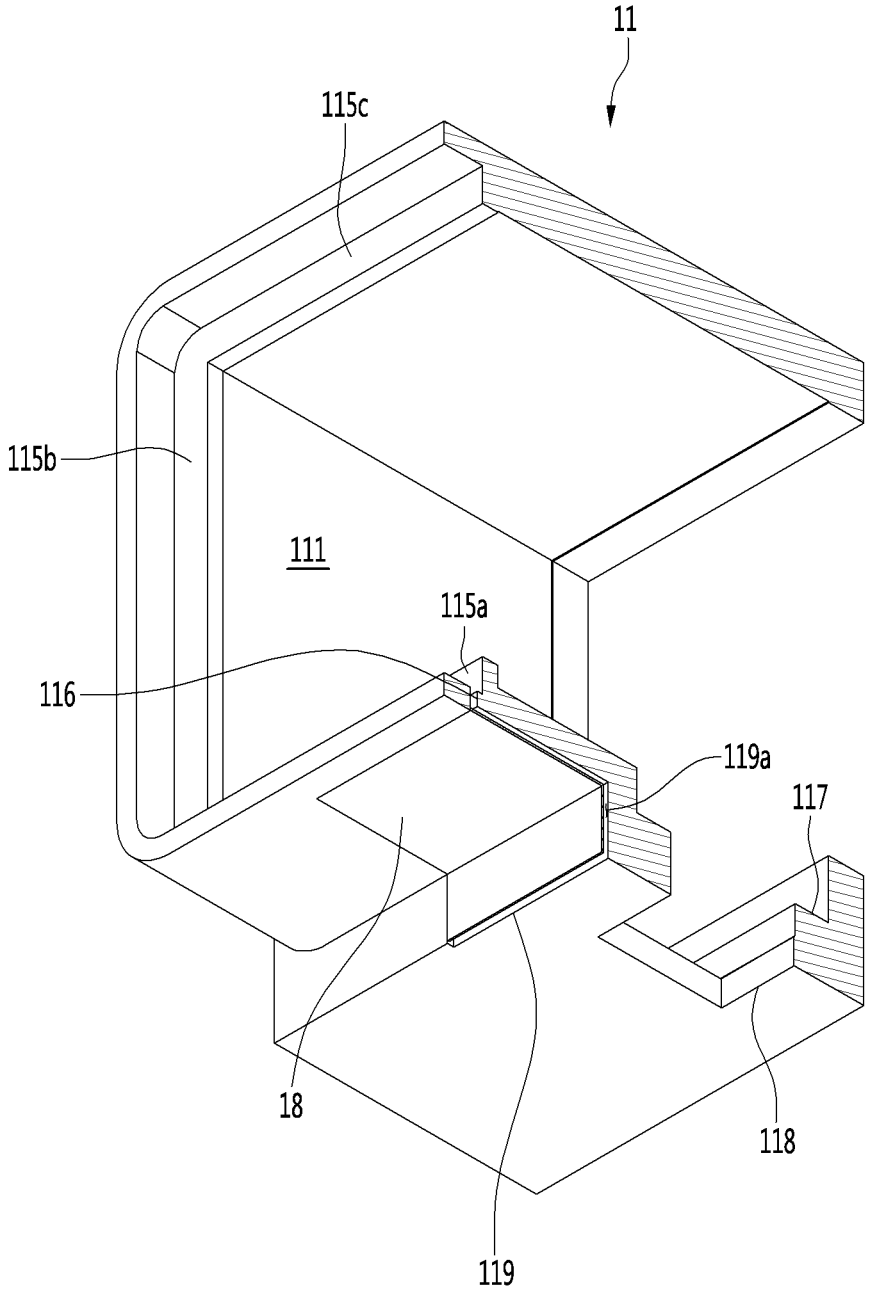
FIG. 12 is a side cross-sectional view taken along line 12-12 of FIG. 11.

FIG. 11 is a perspective view of the cabinet 11 constituting the entrance refrigerator 10, according to an embodiment, and FIG. 12 is a side cross-sectional view taken along line 12-12 of FIG. 11.

Referring to FIGS. 11 and 12, the cabinet 11 constituting the entrance refrigerator 10 according to the embodiment has a hexahedral shape in which the front side and the rear side are opened.

The cabinet 11 may include a first portion 112 (exterior portion) inserted through the front door 1 or the wall, and a second portion 113 (interior portion) exposed to the inside.

The lower end of the second portion 113 may extend downward further than the lower end of the first portion 112. In detail, the front surface of the second portion 113 extending downward from the rear end of the bottom of the first portion 112 may be defined as a door contact surface 114. Like the front surface of the housing 15, the door contact surface 114 prevents the entrance refrigerator 10 from being separated from the front door 1 or the wall by the moment.

A contact shoulder 115 may be formed at a point spaced apart rearward from the front end of the cabinet 11 by a predetermined distance.

The contact shoulder 115 may protrude from the inner circumferential surface of the cabinet 11 by a predetermined height, and may have a rectangular band shape extending along the inner circumferential surface of the cabinet 11.

A rectangular opening defined along the inner edge of the contact shoulder 115 may define an inlet portion for goods entering or exiting the storage compartment 111.

A space between the front end of the cabinet 11 and a front surface of the contact shoulder 115 may be defined as an outdoor side door accommodation portion into which the outdoor side door 12 is received.

In a state in which the outdoor side door 12 is closed, the outer gasket 21 is in close contact with the front surface of the contact shoulder 115 to prevent leakage of cold air from the storage compartment 111.

The longitudinal cross-section of the storage compartment 111 defined at the rear of the contact shoulder 115 may have the same size as the longitudinal cross-section of the inlet portion. That is, the bottom surface of the storage compartment 111 may be coplanar with the upper edge of the contact shoulder 115 extending from the inner circumferential surface of the bottom portion of the cabinet 11. The bottom surface of the storage compartment 111 may include the base plate 20.

In addition, the left and right side surfaces of the storage compartment 111 may be coplanar with the inner edges of the contact shoulder 115 extending from the left inner circumferential surface and the right inner circumferential surface of the cabinet 11, respectively.

Finally, the ceiling surface of the storage compartment 111 may be coplanar with the lower edge of the contact shoulder 115 extending from the inner circumferential surface of the upper end of the cabinet 11.

In summary, it can be understood that the inner circumferential surface of the storage compartment 111 is coplanar with the inner edges of the contact shoulder 115.

However, the present disclosure is not limited to the above configuration. For example, the bottom surface of the storage compartment 111 may be coplanar with the bottom surface of the outdoor side door accommodation portion.

In detail, the contact shoulder 115 may be described as including a lower shoulder 115*a*, a left shoulder 115*b*, a right shoulder (see FIG. 6), and an upper shoulder 115*c*, and the bottom surface (floor) of the storage compartment 111 may be designed to be lower than the upper edge of the lower shoulder 115*a*.

In addition, the left and right side surfaces of the storage compartment 111 may be designed to be wider than the inner edges of the left shoulder 115*b* and the right shoulder.

Finally, the upper surface (ceiling) of the storage compartment 111 may be designed to be higher than the lower edge of the upper shoulder 115*c*.

According to this structure, the width and height of the storage compartment 111 may be formed to be larger than the width and height of the inlet portion.

A slot 116 may be formed at the bottom of the cabinet corresponding to the bottom of the outdoor side door accommodation portion.

The point where the slot 116 is formed may be described as a point spaced a predetermined distance rearward from the front end of the cabinet 11, or a point spaced a predetermined distance forward from the front surface of the contact shoulder 115.

The slot 116 may be formed at a position closer to the contact shoulder 115 than to the front end of the cabinet 11. As the air that has a relatively high temperature and is discharged from the housing 15 rises, the air may be introduced into the outdoor side door accommodation portion of the cabinet 11 through the slot 116.

The air flowing through the slot 116 flows along the edge of the outer gasket 21 to evaporate any condensation that may form on the outer gasket 21.

In detail, an inwardly stepped portion 119 may be formed in the bottom surface of the cabinet 11 corresponding to the first portion 112 and in the front surface of the cabinet 11 corresponding to the second portion 113. The stepped portion 119 is enclosed by the guide plate 18, and an air flow passage 119*a* is formed between the guide plate 18 and the stepped portion 119. The lower end of the air flow passage 119*a* communicates with the inside of the housing 15, and the upper end of the air flow passage 119*a* is connected to the slot 116.

Due to this structure, the relatively high-temperature air discharged from the housing 15 moves along the air flow passage 119*a* and flows into the slot 116.

A mount plate seating portion 117 may be formed at a predetermined depth on the inner bottom surface of the cabinet 11, particularly on the bottom surface of the cabinet 11 corresponding to the second portion 113.

A cold air suction hole 118 may be formed on the bottom of the mount plate seating portion 117. The mount plate 24 is mounted on the mount plate seating portion 117 such that the through-hole 242 and the cold air suction hole 118 are aligned in the vertical direction.

In addition, the flow guide 23 is disposed above the mount plate seating portion 117, particularly on the upper surface of the mount plate 24.

Figure 13:
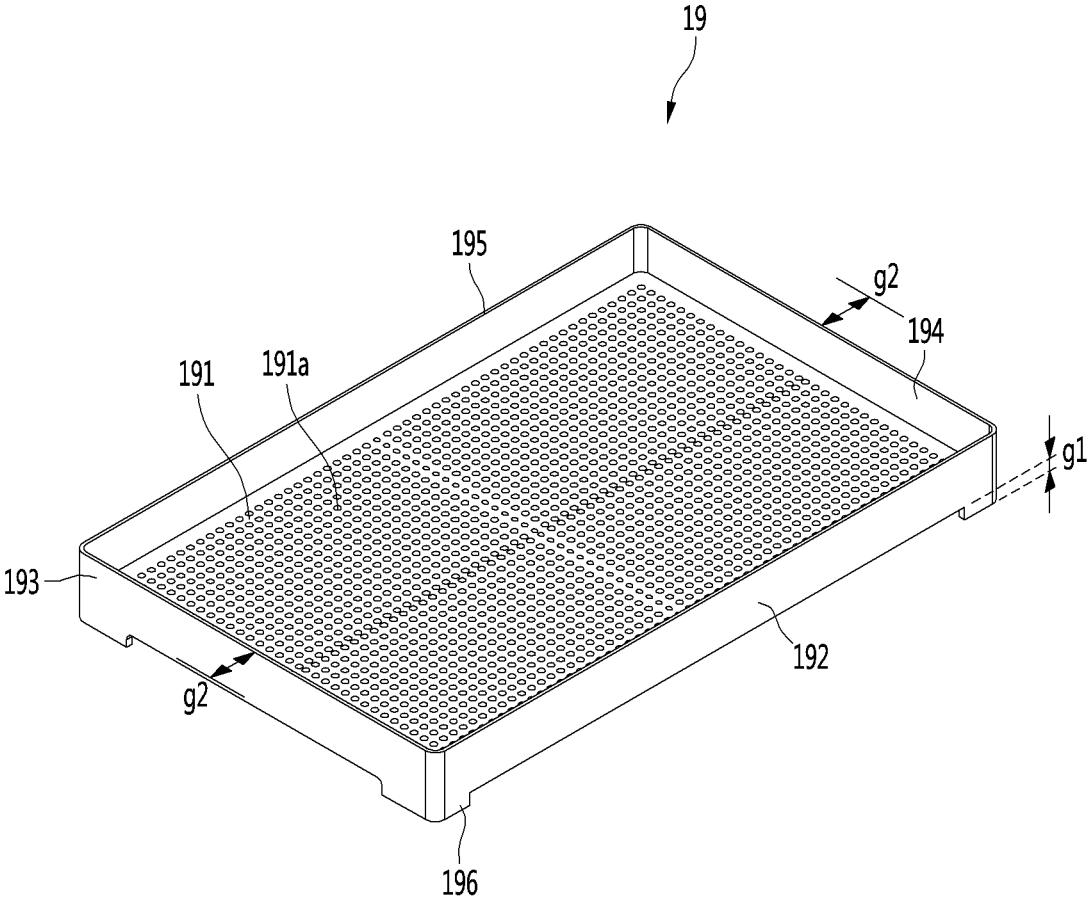
FIG. 13 is a perspective view of a tray accommodated in a storage compartment of the entrance refrigerator, according to an embodiment.

FIG. 13 is a perspective view of the tray 19 accommodated in the storage compartment 111 of the entrance refrigerator 10, according to an embodiment.

Referring to FIG. 13, the tray 19 according to the embodiment may include a rectangular bottom portion 191, an edge wall surrounding the edge of the bottom portion 191 and extending to a predetermined height, and legs 196 extending downward from four corners of the bottom portion 191.

A plurality of through-holes 191*a* may be formed in the bottom portion 191.

The edge wall may include a front portion 192, a left side portion 193, a right side portion 194, and a rear side portion 195.

The bottom portion 191 is spaced apart from the bottom of the storage compartment 111 by the legs 196 to form a lower gap g1.

The height of the lower gap g1 corresponds to the height of the legs 196, and the width of the lower gap g1 corresponds to the distance between two adjacent legs.

In addition, the left-to-right width of the bottom portion 191 is formed to be smaller than the left-to-right width of the storage compartment 111, such that the edge wall of the tray 19 and the sidewall of the storage compartment 111 are separated by a predetermined distance to form a side gap g2. The front-to-rear width of the bottom portion 191 may also be formed to be smaller than the front-to-rear width of the storage compartment 111 to form a side gap.

The side gap g2 may be about 5 mm, but the dimension of the gap g2 is not limited thereto.

Figure 14:
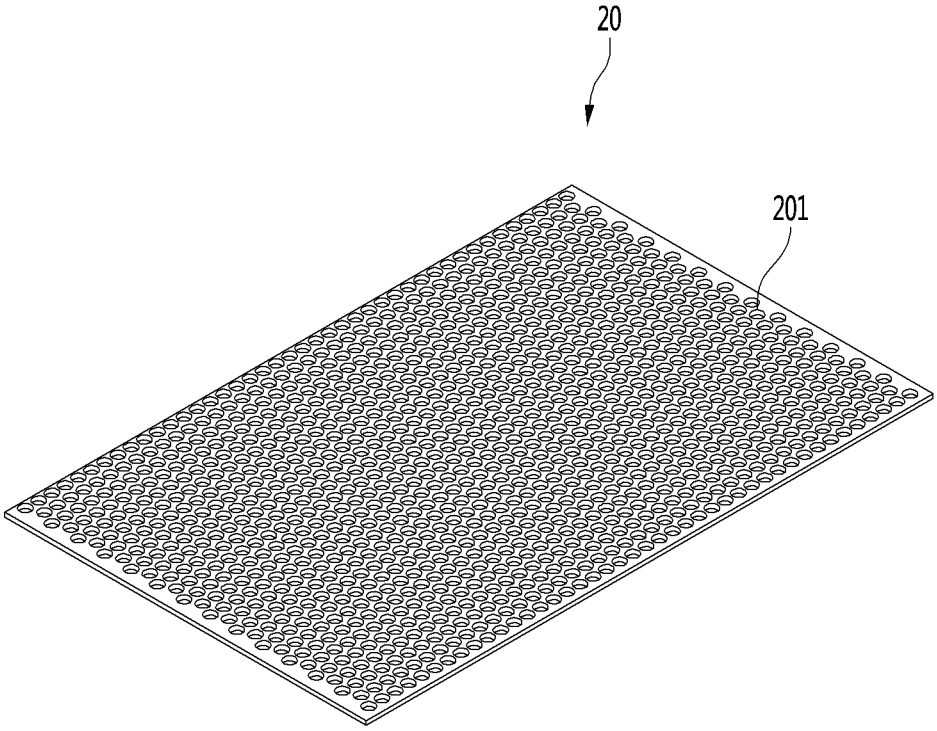
FIG. 14 is a perspective view of a base plate disposed on the bottom of the storage compartment of the entrance refrigerator, according to an embodiment.

FIG. 14 is a perspective view of the base plate 20 disposed on the bottom of the storage compartment 111 of the entrance refrigerator 10, according to an embodiment.

Referring to FIG. 14, the base plate 20 according to the embodiment may be formed to be the same size as the bottom portion 191 of the tray 19. Alternatively, the base plate 20 may be formed to be the same size as the bottom portion of the storage compartment 111.

A plurality of through-holes 201 may be formed in the base plate 20, and the plurality of through-holes 201 may include circular holes or polygonal holes.

Referring to FIGS. 9 to 11, the base plate 20 may be spaced apart from the bottom surface of the storage compartment 111 by a predetermined interval.

The separation distance between the base plate 20 and the bottom surface of the storage compartment 111 is set to a dimension in consideration of the height of the lower shoulder 115*a*, so that the upper surface of the base plate 20 and the lower shoulder 115*a* may form the same plane.

According to this configuration, when the user or the delivery person withdraws the tray 19 from the storage compartment 111 or inserts the tray 19 into the storage compartment 111, the lower shoulder 115*a* does not act as an obstacle that prevents the tray 19 from being inserted or withdrawn.

That is, there is an advantage that the tray 19 can be pulled out by sliding the tray 19 on the base plate 20.

In addition, since the separation space is formed between the base plate 20 and the bottom surface of the storage compartment 111, the cold air guided by the flow guide 23 is evenly distributed throughout the lower portion of the storage compartment 111.

The separation distance between the base plate 20 and the bottom surface of the storage compartment 111 may be about 15 mm, but the separation distance is not limited thereto.

Figure 15:
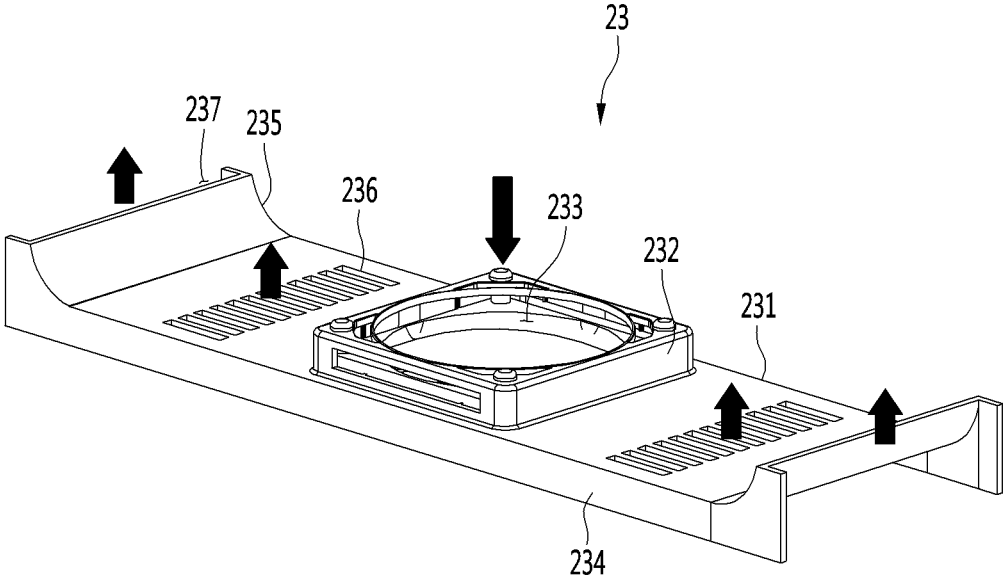
FIG. 15 is a perspective view of a flow guide disposed on the bottom of the entrance refrigerator, according to an embodiment.

FIG. 15 is a perspective view of the flow guide 23 disposed on the bottom of the entrance refrigerator 10, according to an embodiment.

Referring to FIG. 15, the flow guide 23 according to the embodiment may include a bottom portion 231, curved portions 235 extending upward from the left and right edges of the bottom portion 231 in a rounded form, extension ends 234 extending downward from the front end and the rear end of the bottom portion 231 and the curved portions 235, and a fan housing 232 protruding upward from the center of the upper surface of the bottom portion 231.

The extension ends 234 may include a front extension end extending downward from the front end of the bottom portion 231 and the front ends of the curved portions 235, and a rear extension end extending downward from the rear end of the bottom portion 231 and the rear ends of the curved portions 235.

The ends of the curved portions 235 and the extension ends 234 define side discharge ports at the left and right edges of the flow guide 23, respectively.

In addition, main discharge ports 236 may be formed at points spaced apart from the fan housing 232 to the left and the right of the fan housing 232 by a predetermined distance. The main discharge ports 236 may be formed by a plurality of slits that extend a predetermined length in the left-to-right direction of the flow guide 23 and are spaced apart in the front-to-rear direction of the flow guide 23. However, the main discharge ports 236 may also be provided in the form of one or more openings elongated in the front-to-rear direction of the flow guide 23.

The fan housing 232 may protrude a predetermined height from the bottom portion 231 so as to accommodate the heat absorption fan 33. A suction port 233 may be formed in the upper surface of the fan housing 232.

Due to this structure, when the heat absorption fan 33 is rotated, cold air inside the storage compartment 111 is guided toward the cold sink 32 through the suction port 233. The cold air cooled while passing through the cold sink 32 flows in the horizontal direction of the flow guide 23. The cold air flowing in the horizontal direction of the flow guide 23 forms a circulation flow path discharged into the storage compartment 111 through the main discharge ports 236 and the side discharge ports 237.

Meanwhile, the left end and the right end of the flow guide 23 are in close contact with the left edge and the right edge of the mount plate seating portion 117. As a result, the side discharge ports 237 are formed on the upper surface of the flow guide 23, such that the cold air is discharged upward toward the ceiling of the storage compartment 111.

Figure 16:
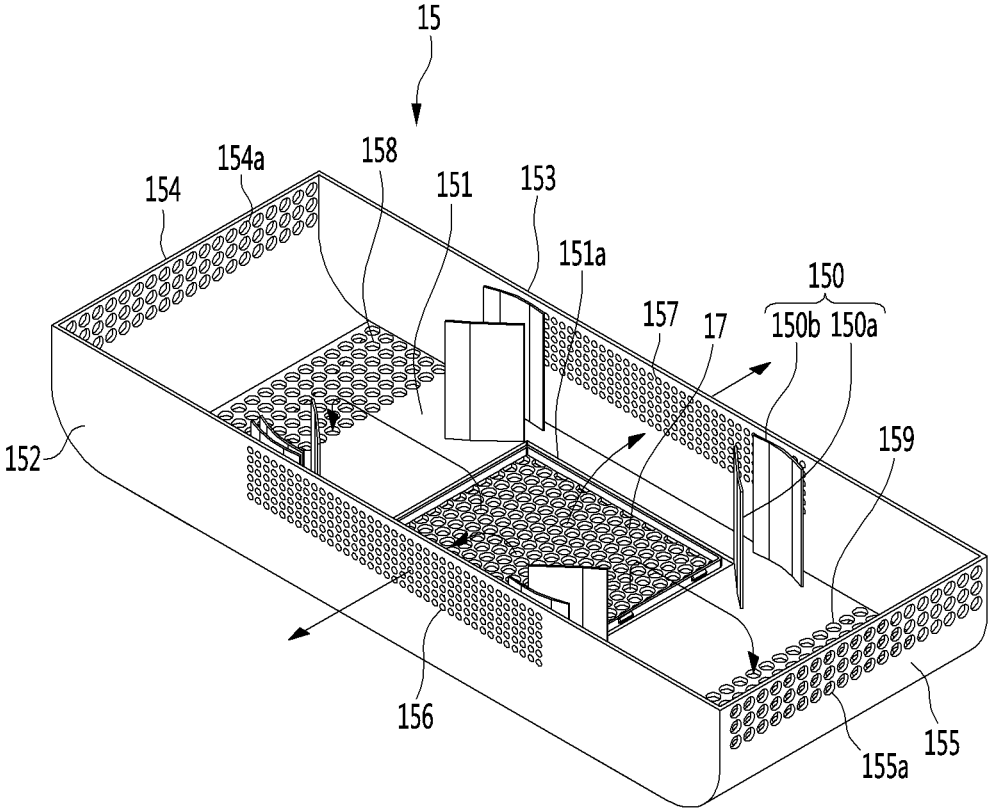
FIG. 16 is a perspective view showing the internal structure of a housing of the entrance refrigerator, according to an embodiment.
Figure 17:
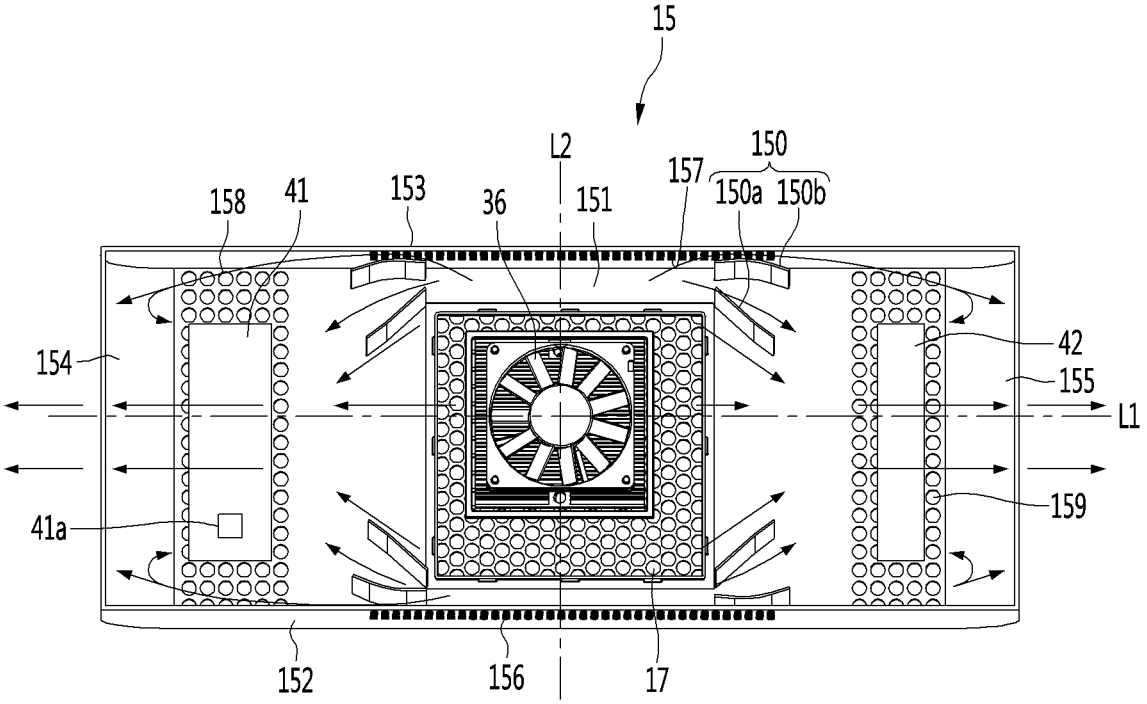
FIG. 17 is a plan perspective view of the housing in which printed circuit boards are disposed, according to an embodiment.

FIG. 16 is a perspective view showing the internal structure of the housing 15 of the entrance refrigerator 10, according to an embodiment, and FIG. 17 is a plan perspective view of the housing 15 in which printed circuit boards are disposed.

Referring to FIGS. 16 and 17, the housing 15 according to the embodiment is coupled to the lower end of the cabinet 11, specifically the lower end of the cabinet 11 defined as the second portion 113.

One portion of the cold air supply device 30 is accommodated in the housing 15, and another portion of the cold air supply device 30 is accommodated in the lower space of the cabinet 11 corresponding to the second portion 113.

In one example, the heat absorption fan 33, the cold sink 32, and the thermoelectric element 31 may be accommodated in the lower space of the second portion 113 of the cabinet 11, and the heat sink 34 and the heat dissipation fan 36 may be accommodated in the housing 15. However, this arrangement may be changed according to design conditions.

The housing 15 may include a bottom portion 151, a front surface portion 152 extending upward from the front end of the bottom portion 151, a rear surface portion 153 extending upward from the rear end of the bottom portion 151, a left surface portion 154 extending upward from the left end of the bottom portion 151, and a right surface portion 155 extending upward from the right end of the bottom portion 151.

A pair of guide ducts 16 are mounted on the bottom surface of the bottom portion 151.

A suction hole 151*a* is formed at the center of the bottom portion 151, and a suction plate 17 is mounted over the suction hole 151*a*.

A left discharge port 158 and a right discharge port 159 are formed on the left edge and the right edge of the bottom portion 151, respectively. The left discharge port 158 and the right discharge port 159 may be composed of an assembly of circular or polygonal holes. However, the present disclosure is not limited thereto, and each of the left discharge port 158 and the right discharge port 159 may have a rectangular hole shape having a predetermined width and length.

The guide ducts 16 are mounted directly below the left discharge port 158 and the right discharge port 159, respectively.

One or more flow guide plates 150 may be disposed on the upper surface of the bottom portion 151 corresponding to four corner portions of the suction hole 151*a*. In detail, a plurality of flow guide plates 150 may be disposed at the four corner portions of the suction hole 151*a*. A portion of outside air introduced into the housing 15 through the suction plate 17 that exchanges heat with the heat sink 34 may be guided to the left discharge port 158 and the right discharge port 159 by the flow guide plate 150.

A front discharge port 156 and a rear discharge port 157 may be formed at the centers of the front surface portion 152 and the rear surface portion 153, respectively. A portion of the outside air introduced through the suction plate 17 may exchange heat with the heat sink 34 and may be discharged to the outside through the front discharge port 156 and the rear discharge port 157.

The front discharge port 156 and the rear discharge port 157 may also be defined as an assembly of a plurality of holes, but the present disclosure is not limited thereto. However, since the discharge ports 156, 157, 158 and 159 are composed of a plurality of holes having a small diameter, it is possible to minimize the introduction of foreign substances into the housing 15.

The guide plate 18 may be coupled to the cabinet 11 as an independent member, or may be a part of the housing 15 extending upward from the upper end of the front surface portion 152 and bent forward.

The left surface portion 154 and the right surface portion 155 may extend upward from the left and right edges of the bottom portion 151 in a rounded form.

The PCB may be disposed in the housing 15 in order to cool the PCB on which the electrical components generating a large amount of heat are mounted.

The electrical components for controlling the driving of at least the cold air supply device 30 may be mounted on the PCB.

In detail, the PCB may include a main PCB 41 and a sub PCB 42, but the present disclosure is not necessarily limited thereto. It is noted that the PCB generating a large amount of heat is disposed on a flow passage of indoor air forcedly flowing due to the heat dissipation fan 36 such that the PCB is naturally cooled.

The main PCB 41 may be disposed above the left discharge port 158, and the sub PCB 42 may be disposed above the right discharge port 159.

However, when there is only one PCB installed in the entrance refrigerator 10, the PCB may be disposed above only one of the left discharge port 158 and the right discharge port 159.

In addition, when there is a plurality of PCBs, the PCBs need not be right above the left discharge port 158 and the right discharge port 159. In other words, the PCBs may be appropriately disposed in a space between the suction plate 17 and the left surface portion 154, and a space between the suction plate 17 and the right surface portion 155.

In addition, the PCBs 41 and 42 may be fixed at positions spaced apart by a predetermined interval upward from the bottom portion 151 of the housing 15 in order to prevent the left discharge port 158 and the right discharge port 159 from being blocked by the PCBs 41 and 42.

As one method, a fastening screw passing through the edge of the PCB is inserted into and fixed to the bottom surface of the cabinet 11. The insertion depth of the fastening screw may be adjusted to allow the PCB to be disposed in a space between the bottom surface of the cabinet 11 and the bottom portion 151 of the housing 15.

A left heat dissipation hole 154*a* and a right heat dissipation hole 155*a* may be formed in the left surface portion 154 and the right surface portion 155, respectively, in order to quickly discharge, to the outside of the housing 15, the indoor air absorbing heat while passing over and/or through the PCBs 41 and 42.

The indoor air flowing in the horizontal direction while cooling the PCBs may be discharged through the left and right heat dissipation holes 154*a* and 155*a*, and the flow resistance may be minimized because there is no switching of the air flow direction in the flow passage.

A portion of the air absorbing heat from the PCBs may be discharged into the room through the left discharge port 158 and the right discharge port 159 by switching the flow passage. Another portion of the air absorbing heat from the PCBs may be discharged through the left heat dissipation hole 154*a* and the right heat dissipation hole 155*a*.

In order to ensure that the indoor air forcibly flowing inside the housing 15 due to the heat dissipation fan 36 is concentrated toward the PCBs 41 and 42, the flow guide plate 150 may be provided inside the housing 15.

The flow guide plate 150 may extend by a predetermined height and a predetermined length near four corners of the suction plate 17.

The flow guide plate 150 may be symmetrically formed with respect to a center line L1 that bisects the housing 15 in a front-to-back direction.

The flow guide plate 150 may be symmetrically formed with respect to a center line L2 that bisects the housing 15 in a left-to-right direction.

The flow guide plate 150 may include an inner flow guide plate 150*a* located at a point spaced apart from the center line L1 by a predetermined interval, and an outer flow guide plate 150*b* located at a point farther away from the center line L1 than the inner flow guide plate 150*a*.

The inner flow guide plate 150*a* may extend in a lateral direction of the housing 15 from a point close to the edge of the suction plate 17. The inner flow guide plate 150*a* may be slanted in a direction closer to the center line L1 toward the lateral direction of the housing 15. The inner flow guide plate 150*a* may extend straight, or may extend to be bent once or more, or may be smoothly rounded with a predetermined curvature.

The outer flow guide plate 150*b* may also extend in the lateral direction of the housing 15 from the point close to the edge of the suction plate 17. In addition, the outer flow guide plate 150*b* may also be slanted in a direction closer to the center line L1. In addition, like the inner flow guide plate 150*a*, the outer flow guide plate 150*b* may also extend straight, or may be bent a plurality of times, or may be smoothly rounded.

As the inner flow guide plate 150*a* extends obliquely in a direction closer to the center line L1, the air forcedly flowing due to the heat dissipation fan 36 concentrates on and flows toward the center of the PCBs. Therefore, it is advantageous to install a PCB in which electrical components generating a large amount of heat are installed in the center of the PCB.

According to the arrangement of the electrical components mounted on the PCB, the extension direction of the flow guide plate 150 may be appropriately adjusted. That is, by allowing a relatively large amount of air to flow toward the electrical component generating a large amount of heat, the cooling rate of the electric component mounted on the PCB may be maintained uniformly over the entire PCB.

Figure 18:
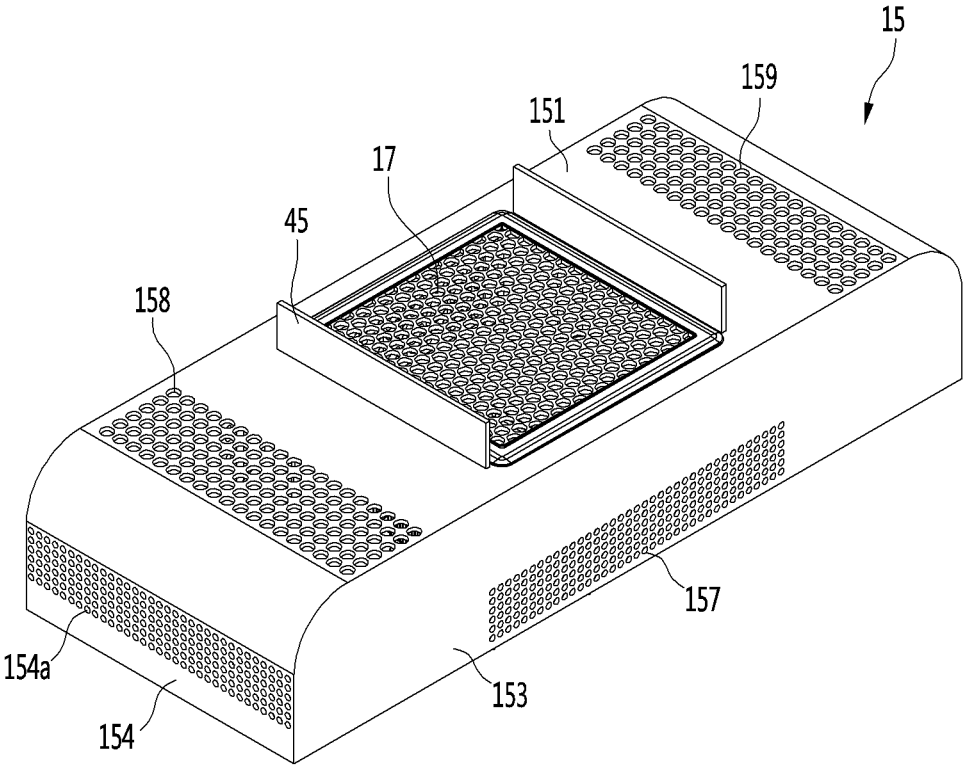
FIG. 18 is a bottom perspective view of the housing in which a flow separation plate is attached to a bottom of the housing 15, according to an embodiment.

FIG. 18 is a bottom perspective view of the housing 15 in which a flow separation plate is attached to a bottom of the housing 15, according to an embodiment.

Referring to FIG. 18, the flow separation plate 45 may be attached to the bottom of the housing 15 in order to minimize or prevent mixing of the indoor air introduced into the housing 15 through the suction plate 17 and the indoor air discharged into the room through the left discharge port 158 and the right discharge port 159.

The flow separation plate 45 may be disposed at the left edge region and the right edge region of the suction plate 17, and may extend from the bottom surface of the housing 15 by a predetermined distance.

The flow separation plate 45 may extend in the front-to-rear direction of the housing 15 by a length corresponding to the lengths of the left and right surfaces of the suction plate 17. The flow separation plate 45 is preferably formed to be equal to or longer than the length of the side surface portions of the suction plate 17.

The flow separation plate 45 may minimize an occurrence in which high-temperature indoor air discharged from the left discharge port 158 and the right discharge port 159 is re-introduced through the suction plate 17.

The indoor air discharged through the left discharge port 158 and the right discharge port 159 absorbs heat from the heat sink 34 of the cold air supply device 30 and the PCBs 41 and 42, and thus, the temperature of the indoor air increases. As such, when the air having the increased temperature is re-introduced into the housing 15 through the suction plate 17, the heat dissipation capability of the heat sink 34 and the PCBs 41 and 42 may be significantly reduced. In order to minimize such an occurrence, the flow separation plate 45 is provided on the bottom of the housing 15.

Figure 19:
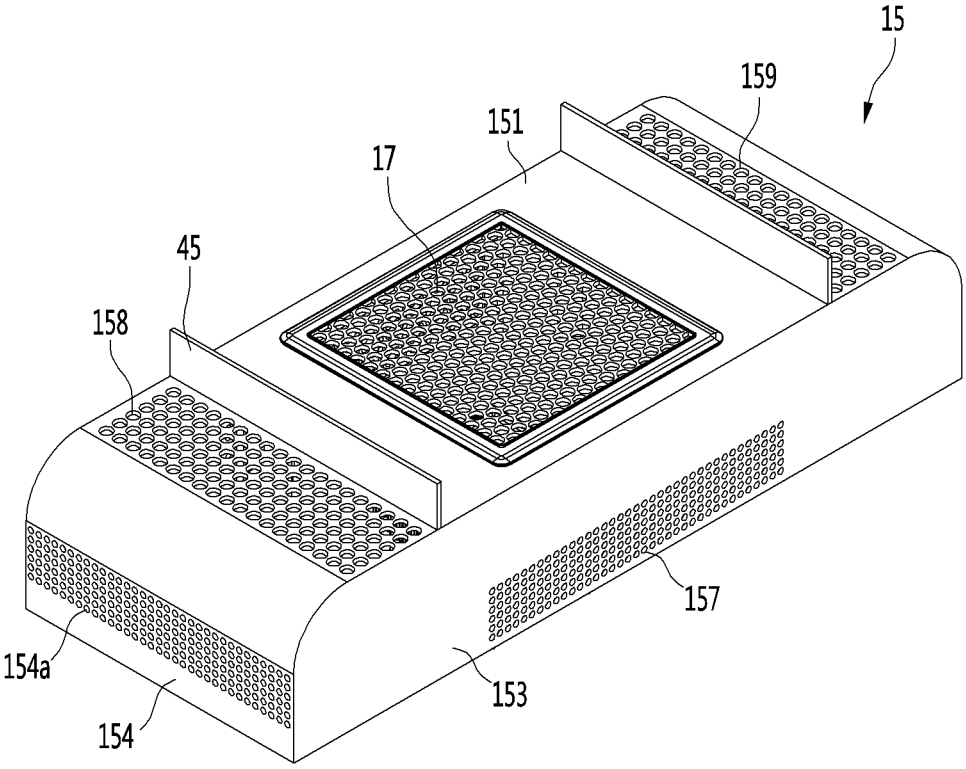
FIG. 19 is a bottom perspective view of a housing provided with a flow separation plate, according to another embodiment.

FIG. 19 is a bottom perspective view of a housing 15 provided with a flow separation plate 45, according to another embodiment.

Referring to FIG. 19, in the housing 15 according to the present embodiment, the flow separation plate 45 is disposed at points adjacent to side edges of the left discharge port 158 and the right discharge port 159.

As proposed in the present embodiment, the flow separation plate 45 is installed at a point closer to the left discharge port 158 and the right discharge port 159 than the suction plate 17, thereby minimizing a flow resistance of the indoor air introduced through the suction plate 17.

The flow separation plates 45 proposed in FIGS. 18 and 19 may be disposed in positions facing each other, so as to extend downward in a direction away from each other. As such, since the distance between the lower ends of the flow separation plates 45 facing each other is longer than the distance between the upper ends thereof, the flow resistance of the air introduced into the suction plate 17 may be minimized and the suction flow rate may be increased.

Furthermore, since the indoor air discharged through the left discharge port 158 and the right discharge port 159 is discharged downward in a direction away from each other, the possibility of re-introduction of the discharged air through the suction plate 17 is significantly reduced.

Figure 20:
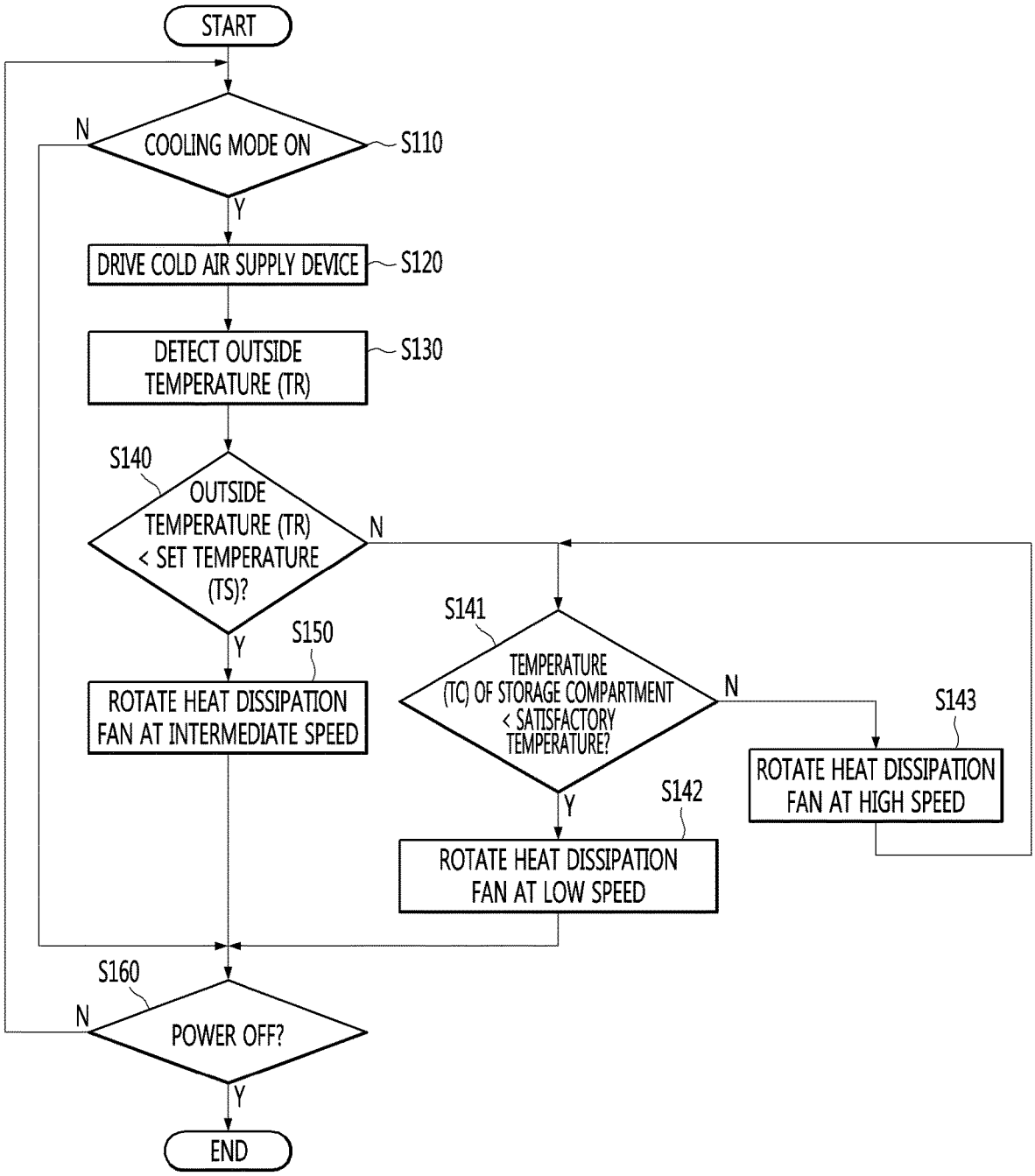
FIG. 20 is a flowchart describing a heat dissipation fan driving algorithm of a cold air supply device for cooling a PCB.

FIG. 20 is a flowchart for describing a heat dissipation fan driving algorithm of a cold air supply device 30 for cooling the PCBs 41 and 42.

Referring to FIG. 20, the heat dissipation fan 36 of the cold air supply device 30 must be driven in order to cool the PCBs 41 and 42 installed in the entrance refrigerator 10.

In detail, power consumption is inevitable in order to drive the heat dissipation fan 36. Therefore, there is a need to consider the best method for effectively cooling the PCBs 41 and 42 while minimizing the power consumption.

To this end, the temperature of the space in which the housing 15 of the entrance refrigerator 10 is installed (hereinafter, defined as an outside temperature) and the temperature of the storage compartment 111 of the entrance refrigerator 10 are preferably considered together.

First, a controller 41*a* of the entrance refrigerator 10 determines whether a current cooling mode is turned on (S110). For reference, the controller 41*a* may be understood as meaning a microcontroller component installed on one of the PCBs 41 and 42.

The cooling mode may be defined as an operation mode for maintaining the storage compartment 111 at a refrigerating temperature or a freezing temperature.

When the cooling mode is on and the cold air supply device 30 is being operated, a detecting of an outside temperature TR is performed (S130).

However, when a cooling mode on command is inputted and the cold air supply device 30 is determined to be in a non-driven state, the controller 41*a* drives the cold air supply device 30 by supplying power to the cold air supply device 30 (S120). The driving of the cold air supply device 30 may be understood as power being supplied to the thermoelectric element 31, and power being supplied to the heat absorption fan 33 and the heat dissipation fan 36 to cause them to rotate.

The outside temperature may be understood as including one of the indoor temperature or the outdoor temperature. For example, when the air introduced into the housing 15 by the heat dissipation fan 36 is indoor air, the outside temperature may be understood as referring to the indoor temperature, and when the air introduced into the housing 15 is outdoor air, the outside temperature may be understood as referring to the outdoor temperature.

The controller 41*a* determines whether the detected outside temperature TR is lower than a set temperature TS (S140). When it is determined that the outside temperature TR is lower than the set temperature TS, the heat dissipation fan 36 is controlled to rotate at an intermediate speed (S150).

The set temperature TS may be 35° C. corresponding to a summer daytime temperature, but the present disclosure is not limited thereto. When the outside temperature TR is lower than the set temperature TS, the temperature of the air suctioned by the heat dissipation fan 36 is not excessively high. Therefore, since the suctioned outside air is unlikely to adversely affect the cooling of the PCBs 41 and 42, the rotational speed of the heat dissipation fan is maintained at an intermediate level.

However, when the outside temperature TR is higher than the set temperature TS, it is necessary to adjust the rotational speed of the heat dissipation fan 36 in consideration of the current temperature TC of the storage compartment.

In detail, the controller 41*a* determines whether the current temperature TC of the storage compartment 111 is maintained below a satisfactory temperature (S141).

When the temperature of the storage compartment 111 is maintained below the satisfactory temperature, it can be understood as a situation in which the cold air supply device 30 does not need to be driven, or may be driven with low output if driven. Therefore, in order to cool the PCBs 41 and 42, the controller 41*a* may control the heat dissipation fan 36 to rotate at a low speed (S142). By doing so, the power consumption for driving the cold air supply device 30 may be reduced, and the PCBs 41 and 42 may be cooled.

In contrast, when the temperature of the storage compartment 111 is higher than the satisfactory temperature, that is, an unsatisfactory temperature, it may be understood as a situation in which the output of the cold air supply device 30 must be increased for cooling the storage compartment 111 and at the same time the PCBs 41 and 42 must be cooled.

When the amount of current supplied to the thermoelectric element 31 is increased in order to lower the temperature of the storage compartment 111 to the satisfactory temperature, the surface temperature of the heat sink 34 increases. Therefore, the temperature of the air passing through the heat sink 34 becomes high, and the cooling performance of the PCBs 41 and 42 may be degraded.

Therefore, in order to prevent the cooling performance of the PCBs 41 and 42 from being degraded, the heat dissipation fan 36 is rotated at a high speed to increase the amount of air flowing per unit time (S143).

When the amount of the air flowing per unit time increases, the temperature increase amount of the air passing through the heat sink 34 is lowered. Therefore, the ability of the air passing through the heat sink 34 to cool the PCBs 41 and 42 is not degraded.

When the temperature of the storage compartment 111 is lowered below the satisfactory temperature while the heat dissipation fan 36 is rotated at a high speed, the rotational speed of the heat dissipation fan 36 may be switched to a low speed in order to minimize power consumption.

As described above, the heat dissipation fan rotation algorithm for cooling the PCBs 41 and 42 may be repeatedly performed unless the power of the entrance refrigerator 10 is turned off (S160).

The above-disclosed subject matter is to be considered illustrative, and not restrictive, and the appended claims are intended to cover all such modifications, enhancements, and other embodiments, which fall within the true spirit and scope of the present disclosure.

Thus, the technical spirit of the present disclosure is not limited to the foregoing embodiment.

Therefore, the scope of the present disclosure is defined not by the detailed description of the invention but by the appended claims, and all differences within the scope will be construed as being included in the present disclosure.

What is claimed is:

1. An entrance refrigerator, comprising:

a cabinet configured to extend through a door or a wall, the cabinet including a storage compartment therein for storing goods;

a housing located at a lower side of the cabinet;

an outdoor side door coupled to an outdoor portion of the cabinet to open or close the storage compartment;

an indoor side door coupled to an indoor portion of the cabinet to open or close the storage compartment;

a cold air supplier configured to supply cold air to the storage compartment, at least a portion of the cold air supplier being located in a space defined by the housing and the lower side of the cabinet;

a printed circuit board (PCB) on which electrical components are mounted; and a controller provided on the PCB to control operating of the cold air supply device, wherein the housing includes:

a bottom portion having a suction port through which air is introduced into the housing;

a front portion extending upward from a front end of the bottom portion;

a rear portion extending upward from a rear end of the bottom portion;

a left portion extending upward from a left end of the bottom portion;

a right portion extending upward from a right end of the bottom portion; and a discharge port through which the air introduced through the suction port is discharged from the housing, wherein the entrance refrigerator further comprises a flow guide plate located within the housing and adjacent to the suction port, to provide an air flow passage within the housing between the suction port and the discharge port, and wherein the PCB is disposed within the air flow passage.

2. The entrance refrigerator according to claim 1, wherein the suction port is provided at a center of the bottom portion, and wherein the discharge port comprises:

a left discharge port provided in the bottom portion at a location spaced apart leftward from the suction port; and a right discharge port provided in the bottom portion at a location spaced apart rightward from the section port.

3. The entrance refrigerator according to claim 1, wherein the PCB is disposed at a location spaced apart upward from the discharge port.

4. The entrance refrigerator according to claim 3, wherein the discharge port further comprises:

a left heat dissipation hole provided in the left portion of the housing; and a right heat dissipation hole provided in the right portion of the housing.

5. The entrance refrigerator according to claim 3, further comprising a suction plate located at the suction port, the suction plate including a plurality of suction holes through which air is introduced.

6. The entrance refrigerator according to claim 1, wherein the flow guide plate extends upward from the bottom portion of the housing by a predetermined height and extends in a left-to-right direction of the housing by a predetermined length.

7. The entrance refrigerator according to claim 6, wherein the flow guide plate comprises:

an outer flow guide plate disposed at a location spaced apart forward or rearward from a center line that bisects the housing in a front-to-rear direction; and an inner flow guide plate disposed between the outer flow guide plate and the center line.

8. The entrance refrigerator according to claim 7, wherein the flow guide plate extends in a direction closer to the center line moving along the flow guide plate away from the suction hole toward a left or right edge of the housing.

9. The entrance refrigerator according to claim 1, wherein the cold air supplier comprises:

a thermoelectric element having a heat absorbing surface and a heat generating surface;

a cold sink in contact with the heat absorbing surface;

a heat absorption fan disposed above the cold sink;

a heat sink in contact with the heat generating surface; and a heat dissipation fan disposed below the heat sink.

10. The entrance refrigerator according to claim 9, wherein the cold air supplier further comprises an insulation material located between the cold sink and the heat sink to reduce heat transfer between the heat sink and the cold sink.

11. The entrance refrigerator according to claim 9, wherein the heat sink and the heat dissipation fan are located within the housing, and wherein the heat dissipation fan is located above the suction port.

12. The entrance refrigerator according to claim 9, wherein the controller is configured to set a rotational speed of the heat dissipation fan differently according to an outside temperature of the entrance refrigerator.

13. The entrance refrigerator according to claim 12, wherein the controller is further configured to set the rotational speed of the heat dissipation fan differently according to a temperature of the storage compartment.

14. The entrance refrigerator according to claim 13, wherein the controller is further configured to operate the heat dissipation fan at a first speed in a condition in which the outside temperature is lower than a set temperature.

15. The entrance refrigerator according to claim 14, wherein the controller is further configured to operate the heat dissipation fan at a speed lower than the first speed in a condition in which the outside temperature is higher than the set temperature and a temperature of the storage compartment is equal to or lower than a predetermined temperature.

16. The entrance refrigerator according to claim 15, wherein the controller is further configured to operate the heat dissipation fan at a speed higher than the first speed in a condition in which the outside temperature is higher than the set temperature and a temperature of the storage compartment is above the predetermined temperature.

17. The entrance refrigerator according to claim 1, wherein the flow guide plate extends upward from the bottom portion of the housing by a predetermined height, and wherein the flow guide plate is spaced away from the front portion of the housing, the rear portion of the housing, the left portion of the housing, and the right portion of the housing.

* * * * *